US012631413B2

(12) United States Patent
Wågberg

(10) Patent No.: US 12,631,413 B2
(45) Date of Patent: May 19, 2026

(54) ARRANGEMENT FOR FEEDING AMMUNITION TO A WEAPON

(71) Applicant: BAE Systems Hägglunds Aktiebolag, Örnsköldsvik (SE)

(72) Inventor: Jens Wågberg, Domsjö (SE)

(73) Assignee: BAE Systems Hägglunds Aktiebolag, Örnsköldsvik (SE)

( * ) Notice: Subject to any disclaimer, the term of this patent is extended or adjusted under 35 U.S.C. 154(b) by 0 days.

(21) Appl. No.: 18/840,035

(22) PCT Filed: Feb. 16, 2023

(86) PCT No.: PCT/SE2023/050139
§ 371 (c)(1),
(2) Date: Aug. 20, 2024

(87) PCT Pub. No.: WO2023/163634
PCT Pub. Date: Aug. 31, 2023

(65) Prior Publication Data

US 2025/0237449 A1 Jul. 24, 2025

(30) Foreign Application Priority Data

Feb. 22, 2022 (SE) ..... 2250238-9

(51) Int. Cl.
*F41A 9/14* (2006.01)

(52) U.S. Cl.
CPC ..... *F41A 9/14* (2013.01)

(58) Field of Classification Search
CPC ..... F41A 9/02; F41A 9/14
(Continued)

(56) References Cited

U.S. PATENT DOCUMENTS 2,785,607 A 3/1957 August
3,670,863 A 6/1972 Meier
(Continued)

FOREIGN PATENT DOCUMENTS

FR 2467379 A1 4/1981
WO 2021076031 A1 4/2021

OTHER PUBLICATIONS

International Search Report and Written Opinion mailed May 4, 2023, directed to International Application No. PCT/SE2023/050139; 14 pages.

(Continued)

*Primary Examiner* — Bret Hayes
(74) *Attorney, Agent, or Firm* — Morrison & Foerster LLP

(57) ABSTRACT

The present invention relates to an arrangement for feeding ammunition to a weapon mounted to an elevation device for elevation about an elevation axis, the arrangement comprising an ammunition feeding device arranged between an ammunition channel, from which ammunition is guided, and said weapon, said feeding device being rotatably arranged about a feeding axis, said feeding device having at least one ammunition grip member configured to rotate about said feeding axis between an ammunition collection location at said ammunition channel and an ammunition release location at said weapon, wherein said arrangement is configured such that said at least one ammunition grip member is configured to be rotatably adaptable relative to said feeding axis based on the elevation of said weapon so as to facilitate feeding the ammunition to the weapon in connection to the ammunition release location independent of elevation of said weapon.

25 Claims, 7 Drawing Sheets

(58) Field of Classification Search
USPC ..... 89/33.16, 33.17, 33.25, 34
See application file for complete search history.

(56) References Cited

U.S. PATENT DOCUMENTS

| | | | | | |
|---|---|---|---|---|---|
| 4,079,659 | A * | 3/1978 | Gustavsson | F41A 9/16 | 89/46 |
| 4,416,184 | A | 11/1983 | Jenny | | |
| 4,434,699 | A * | 3/1984 | Tassie | F41A 9/37 | 89/33.04 |
| 4,492,144 | A | 1/1985 | Dix | | |
| 4,719,839 | A * | 1/1988 | Smothers | F41A 9/26 | 414/745.7 |
| H592 | H | 3/1989 | Gillum | | |
| 12,050,077 | B1 * | 7/2024 | Carlson | F41A 9/57 | |
| 12,313,368 | B2 * | 5/2025 | Yu | F41A 9/79 | |

OTHER PUBLICATIONS

Swedish Office Action and Search Report mailed Sep. 26, 2022, directed to SE Application No. 2250238-9; 7 pages.
Extended European Search Report dated Feb. 2, 2026, directed to EP Application No. 23760475.6; 12 pages.

* cited by examiner

ARRANGEMENT FOR FEEDING AMMUNITION TO A WEAPON

CROSS-REFERENCE TO RELATED APPLICATIONS

This application is a U.S. national stage application under 35 U.S.C. 371 of International Application No. PCT/SE2023/050139, filed Feb. 16, 2023, which claims the priority of SE Application No. 2250238-9, filed Feb. 22, 2022. The entire contents of each priority application is incorporated herein by reference.

FIELD OF THE DISCLOSURE

The present invention relates to an arrangement for feeding ammunition to a weapon. The present invention also relates to a vehicle comprising such an arrangement.

BACKGROUND OF THE DISCLOSURE

Automatic weapons require some kind of arrangement for feeding ammunition to the weapon.

According to a variant, a weapon system is provided, where the ammunition is configured to be fed to the weapon from an ammunition magazine via some kind of feeding device.

Combat vehicles such as infantry fighting vehicles or tanks may be equipped with such a weapon system associated with a turret, wherein the weapon system comprises a weapon attached to the turret. For such weapon system, the weapon may be mounted to an elevation device arranged to allow elevation movement of the weapon, wherein ammunition is configured to be fed to the weapon via an ammunition channel, wherein the elevation of the weapon needs to be considered when feeding ammunition to the weapon.

Space for weapon systems may be an issue, particularly for weapon systems associated with a turret configured to house parts of the weapon system.

There is thus a need to provide an arrangement for facilitating feeding ammunition to a weapon.

OBJECTS OF THE DISCLOSURE

An object of the present invention is to provide an arrangement for facilitating feeding ammunition to a weapon in a space efficient way.

Another object of the present invention is to provide a vehicle comprising such an arrangement facilitating feeding ammunition to a weapon in a space efficient way.

SUMMARY OF THE DISCLOSURE

These and other objects, apparent from the following description, are achieved by an arrangement for feeding ammunition to a weapon and a vehicle as set out in the appended independent claims. Preferred embodiments of the arrangement and vehicle are defined in appended dependent claims.

Specifically, an object of the invention is achieved by an arrangement for feeding ammunition to a weapon. The weapon is mounted to an elevation device arranged to allow elevation movement of the weapon about an elevation axis. The arrangement comprises an ammunition feeding device arranged between an ammunition channel, from which ammunition is guided, and said weapon. The elevation movement of the weapon is a movement relative to said ammunition channel. Said feeding device is arranged to feed ammunition from said ammunition channel to said weapon. Said feeding device is rotatably arranged about a feeding. Said feeding device has at least one ammunition grip member configured to rotate with said feeding device about said feeding axis between an ammunition collection location at said ammunition channel, in connection to which said at least one ammunition grip member is configured to collect ammunition from said ammunition channel, and an ammunition release location at said weapon, in connection to which said at least one ammunition grip member is configured to release said collected ammunition so that it is fed into the weapon. Said at least one ammunition grip member is rotatably arranged relative to said feeding axis. Said arrangement is configured such that said at least one ammunition grip member is configured to be rotatably adaptable based on the elevation of said weapon so as to facilitate feeding the ammunition to the weapon in connection to the ammunition release location independent of elevation of said weapon. Said feeding device may comprise any suitable number of ammunition grip members configured to rotate with said feeding device about said feeding axis. Said feeding device may comprise one single ammunition grip member configured to rotate with said feeding device about said feeding axis. Said feeding device may comprise two ammunition grip members configured to rotate with said feeding device about said feeding axis, said two ammunition grip members preferably being arranged opposite to each other, i.e. having a radial extension relative to said feeding axis providing an angle of 180 degrees relative to each other. Said feeding device may comprise three ammunition grip members configured to rotate with said feeding device about said feeding axis, said three ammunition grip members preferably being evenly distributed about said feeding axis, i.e. having a radial extension relative to said feeding axis providing an angle of 120 degrees relative to each other. Said feeding device may comprise four ammunition grip members configured to rotate with said feeding device about said feeding axis, said four ammunition grip members preferably being evenly distributed about said feeding axis, i.e. having a radial extension relative to said feeding axis providing an angle of 90 degrees relative to each other.

By thus providing an arrangement for feeding ammunition to a weapon comprising such ammunition grip member rotatably adaptable based on the elevation of said weapon, efficient and reliable feeding of ammunition to the weapon may be facilitated in a space efficient way. Further, the feeding of ammunition to the weapon may be fed at a high frequency in a safe and controlled way.

According to an embodiment of the arrangement, said arrangement is configured such that said at least one ammunition grip member is configured to be rotatably adaptable based on the elevation angle of said weapon relative to the direction of extension of said feeding axis. According to an aspect of the present disclosure, said weapon is arranged to be elevated within a range between a maximum elevation angle and minimum elevation angle. According to an aspect of the present disclosure, the weapon has a neutral position between said maximum elevation angle and minimum elevation angle. Said neutral position corresponding to a horizontal extension of said weapon when the arrangement comprising the elevation device is arranged at horizontal ground, e.g. when said arrangement is comprised in a weapon system mounted on a vehicle standing on horizontal ground. Said feeding device may be arranged in connection to said weapon so that the direction of extension of said feeding axis has any suitable angle relative to the neutral position of said weapon, i.e. relative to the main direction of extension of the weapon in the neutral position. Thus, when the neutral position of said weapon corresponds to a horizontal extension of the weapon, said feeding device may be arranged in connection to said weapon so that the direction of extension of said feeding axis has any suitable angle relative to the horizontal extension of the weapon. According to an aspect of the present disclosure, said feeding device is configured to be arranged in connection to said weapon so that the direction of extension of said feeding axis essentially corresponds to the direction of extension of said weapon in the neutral position.

According to an embodiment of the arrangement, said feeding device is configured to be arranged so that said feeding axis has a predetermined angle relative to said elevation axis, wherein said ammunition grip member is rotatably arranged about an axis having an angle relative to said feeding axis corresponding to said predetermined angle. Hereby efficient feeding of ammunition to said weapon is facilitated. According to an aspect of the present disclosure, said feeding device is configured to be arranged so that said axis about which said at least one ammunition grip member is rotatable, at said ammunition release location, is configured to essentially align with said elevation axis, further facilitating feeding ammunition into said weapon in connection to said release of said ammunition.

According to an aspect of the present disclosure, when said grip member is positioned in the ammunition release location, the direction of extension of said axis about which said grip member is rotatably arranged is configured to essentially correspond to the direction of extension of said elevation axis. According to an aspect of the present disclosure, when said grip member is positioned in the ammunition release location, the direction of extension of said axis about which said grip member is rotatably arranged is configured to be essentially aligned with the direction of extension of said elevation axis.

According to an embodiment of the arrangement, said at least one ammunition grip member is configured to be subjected to a rotational force based on the elevation angle of the elevation of said weapon relative to the direction of extension of said feeding axis so that said at least one ammunition grip member is rotated about said axis from a neutral non-rotated position at said ammunition collection location to a rotated position corresponding to the elevation angle of the elevation of said weapon relative to the direction of extension of said feeding axis at said ammunition release location so that the ammunition to be released and fed into said weapon is positioned in accordance with the elevation of the weapon. Hereby correct position of the grip member both at the ammunition collection position and at the ammunition release position is provided, facilitating efficient feeding of ammunition to the weapon independent of the elevation angle of the weapon.

According to an embodiment of the arrangement, said feeding device is configured to be arranged so that said feeding axis is essentially orthogonal relative to said elevation axis, wherein said axis about which said ammunition grip member is rotatably arranged is correspondingly essentially orthogonal relative to said feeding axis.

According to an embodiment of the arrangement, said at least one ammunition grip member is resiliently rotatably arranged about said axis so that said at least one ammunition grip member is maintained in said neutral non-rotated position when not subjected to any rotational force and returns to said neutral non-rotated position when a rotational force to which said at least one ammunition grip member has been subjected is released. Hereby correct position of the grip member both at the ammunition collection position and the ammunition release position is provided, facilitating efficient feeding of ammunition to the weapon independent of the elevation angle of the weapon.

According to an embodiment of the arrangement, said feeding device comprises a grip member support configuration configured to rotate about said feeding axis and configured to support said at least one ammunition grip member, wherein said at least one ammunition grip member is connected to and configured to protrude from said grip member support configuration so that said at least one ammunition grip member is rotatable about an axis orthogonal to said feeding axis. By thus providing such a grip member support configuration, robust and efficient support and rotation of said at least one grip member is facilitated so that efficient feeding of ammunition the weapon is provided.

According to an embodiment of the arrangement, said grip member support configuration comprises a rotation axle configured to provide said rotation of said feeding device about said feeding axis and a support member connected to said rotation axle and configured to support said at least one ammunition grip member. Hereby efficient and controlled rotation of said at least one grip member about said feeding axis is facilitated.

According to an embodiment of the arrangement, said at least one ammunition grip member is resiliently connected to said grip member support configuration so that said at least one ammunition grip member is held in a neutral non-rotated position associated with said axis when not subjected to any rotational force for rotation about said axis and so that said at least one grip member returns to said neutral non-rotated position when a rotational force having resulted in a rotation of said at least one ammunition grip member to a rotational position about said axis is released. Hereby correct position of the grip member both at the ammunition collection position and the ammunition release position is provided, facilitating efficient feeding of ammunition to the weapon independent of the elevation angle of the weapon.

According to an embodiment of the arrangement, said at least one ammunition grip member comprises a grip portion configured to collect and release ammunition, and a connection member configured to connect said grip portion to said grip member support configuration so as allow rotation about said feeding axis and so as to facilitate said resilient connection of said at least one ammunition grip member to said grip member support configuration. Hereby rotation of said at least one grip member about said feeding axis and said resilient connection is facilitated in an efficient and controlled way. According to an aspect of the present disclosure, said connection member is configured as a bar or shaft and is arranged to project from said grip member support configuration in a radial direction relative to said feeding axis. According to an aspect of the present disclosure, said connection member has a first end portion configured to be connected to said grip member support configuration and an opposite second end portion configured to be connected to said grip portion.

According to an aspect of the present disclosure, said connection member is resiliently connected to said grip member support configuration so as allow rotation about said axis and configured to support said grip portion.

According to an aspect of the present disclosure, said connection member is fixedly connected to said grip member support configuration and resiliently connected to said grip portion so as allow rotation about said axis.

According to an embodiment, the arrangement further comprises a grip member rotation arrangement configured to rotatably adapt said at least one ammunition grip member based on the elevation of said weapon. Hereby adaption of the rotational position of said at least one grip member may be efficiently controlled based on elevation of said weapon.

According to an embodiment of the arrangement, said grip member rotation arrangement comprises a steering arm configuration fixedly attached to said weapon and/or elevation device arranged to face said feeding device so that said at least one ammunition grip member, when having collected an ammunition and rotating about said feeding axis towards said ammunition release location, is configured to be rotated by means of said steering arm configuration based on the elevation of said weapon. Hereby an easy and efficient way of providing said rotational force based on the elevation angle of the elevation of said weapon for rotating said at least one grip member is facilitated.

According to an embodiment of the arrangement, said steering arm configuration comprises a set of arms arranged so that, when said at least one ammunition grip member has collected an ammunition and is rotating about said feeding axis towards said ammunition release location, said collected ammunition is brought into contact with said set of arms so that said ammunition grip member carrying said ammunition is rotated based on the elevation of said weapon. Hereby an easy and efficient way of providing said rotational force based on the elevation angle of the elevation of said weapon for rotating said at least one grip member is facilitated.

According to an aspect of the present disclosure, said set of arms of said steering arm configuration are arranged so that, when said at least one ammunition grip member has collected an ammunition and is rotating about said feeding axis towards said ammunition release location, said ammunition grip member is brought into contact with said set of arms so that said ammunition grip member carrying said ammunition is rotated based on the elevation of said weapon. Hereby an easy and efficient way of providing said rotational force based on the elevation angle of the elevation of said weapon for rotating said at least one grip member is facilitated.

According to an embodiment of the arrangement, said grip member rotation arrangement comprises an axle configuration configured such that, when said grip member is rotating about said feeding axis towards said ammunition release location, an axial movement in the axial direction of the feeding axis is provided based on the elevation of said weapon, wherein said axial movement is transferred to a rotational movement of said grip member so that said ammunition grip member is rotated based on the elevation of said weapon. Hereby an efficient and controlled way of providing said rotational force based on the elevation angle of the elevation of said weapon for rotating said at least one grip member is facilitated.

According to an embodiment of the arrangement, said axle configuration comprises a bar member for each of said at least one grip member and a bar member contactor fixedly attached to or integrated with said weapon and/or elevation device, said at least one bar member having an axial extension parallel to the feeding axis and being configured to rotate with said feeding device about said feeding axis, wherein, when said grip member is rotating about said feeding axis towards said ammunition release location, said bar member is brought into contact with said bar member contactor providing a force so that said bar member is moved in the axial direction of the feeding axis based on the elevation of said weapon, wherein said bar member is arranged in connection to said grip member so that said axial movement is transferred to said rotational movement of said grip member so that said ammunition grip member is rotated based on the elevation of said weapon. Hereby an efficient and controlled way of providing said rotational force based on the elevation angle of the elevation of said weapon for rotating said at least one grip member is facilitated.

According to an embodiment of the arrangement, said at least one bar member has an end portion configured to be brought in contact with a curved surface portion of said bar member contactor so as to facilitate providing said force so that said bar member is moved in the axial direction of the feeding axis based on the elevation of said weapon. Hereby an efficient and controlled way of providing said rotational force based on the elevation angle of the elevation of said weapon for rotating said at least one grip member is facilitated.

According to an embodiment of the arrangement, said at least one bar member has a bar engagement portion, and said at least one grip member has rotation engagement portion, wherein said bar engagement portion of a bar member is configured to be engaged with said rotation engagement portion of a grip member such that, when said grip member is rotating about said feeding axis towards said ammunition release location so that said bar member is moved in the axial direction of the feeding axis based on the elevation of said weapon, said axial movement is transferred to said rotational movement of said grip member by means of the engagement between said bar engagement portion and said rotation engagement portion. Hereby an efficient and controlled way of providing said rotational force based on the elevation angle of the elevation of said weapon for rotating said at least one grip member is facilitated.

According to an embodiment of the arrangement, said at least one bar member is resiliently arranged so that said at least one grip member is maintained in said neutral non-rotated position when a bar member associated with that grip member is not subjected to a force and thus is not moved in its axial direction, and so that said at least one grip member is returned to said neutral non-rotated position when a force to which said at least one bar member has been subjected, having moved said bar member in its axial direction and transferred said force to said grip member so that said grip member has been rotated to a rotated position is released. Hereby correct position of the grip member both at the ammunition collection position and the ammunition release position is provided, facilitating efficient feeding of ammunition to the weapon independent of the elevation angle of the weapon.

According to an embodiment of the arrangement, said axle configuration comprises a spring member for each of said at least one a bar member so as to provide said resilient arrangement of said at least one bar member. Hereby correct position of the grip member both at the ammunition collection position and the ammunition release position is facilitated by means of said spring member, facilitating efficient feeding of ammunition to the weapon independent of the elevation angle of the weapon.

According to an embodiment of the arrangement, said feeding device is arranged to be rotated about said feeding axis so that said at least one ammunition grip member is rotated about said feeding axis in a rotational plane corresponding to the extension of said elevation axis of said weapon.

According to an embodiment of the arrangement, said feeding device is arranged to be rotated about said feeding axis by means of a drive axle system based on the rate of fire of the weapon so that said at least one ammunition grip member feeds ammunition from said ammunition channel to said weapon by collecting and releasing ammunition in a repeated cycle.

According to an embodiment of the arrangement, said weapon is arranged to be elevated within a range between a maximum elevation angle and minimum elevation angle, the weapon having a neutral position there between, said neutral position corresponding to a horizontal extension of said weapon when the arrangement comprising the elevation device is arranged at horizontal ground.

According to an embodiment of the arrangement, said feeding device comprises three ammunition grip members evenly distributed around said grip member support configuration.

Specifically, an object of the invention is achieved by a vehicle comprising an arrangement for feeding ammunition from an ammunition channel to a weapon of a weapon system mounted on the vehicle as set out herein.

According to an embodiment, the vehicle is a tracked vehicle. According to an embodiment the vehicle is a combat vehicle.

BRIEF DESCRIPTION OF THE FIGURES

For a better understanding of the present disclosure reference is made to the following detailed description when read in conjunction with the accompanying drawings, wherein like reference characters refer to like parts throughout the several views, and in which.

DETAILED DESCRIPTION OF THE DISCLOSURE

Figure 1:
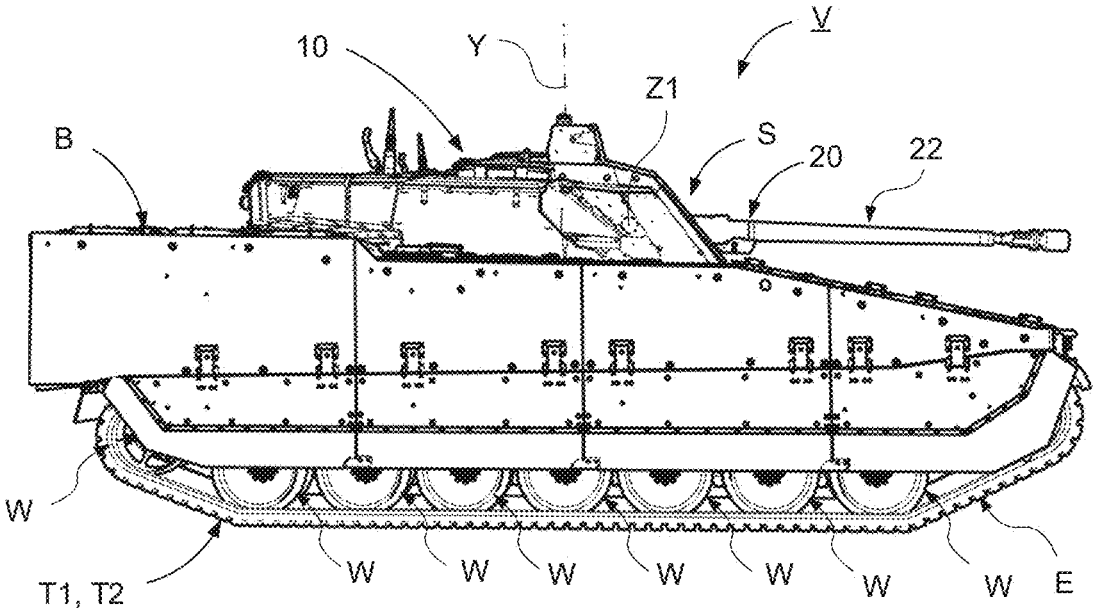
FIG. 1 schematically illustrates a side view of a tracked vehicle according to an embodiment of the present disclosure.

FIG. 1 schematically illustrates a side view of a tracked vehicle V according to an aspect of the present disclosure. The exemplified vehicle V is constituted by a combat vehicle. The tracked vehicle V comprises a vehicle body B, which according to an aspect of the present disclosure comprises the chassis of the vehicle V and bodywork.

The tracked vehicle V comprises a track assembly pair T1, T2 being suspendedly connected to the vehicle body B. The track assembly pair comprises a right track assembly T1 and a left track assembly T2 for driving the vehicle, each track assembly comprising a drive means driven endless track E arranged to run over a set of wheels W of the track assembly.

Even if the illustrated motor vehicle V is a tracked vehicle the motor vehicle V may according to other embodiments of the invention be constituted by a wheeled vehicle.

The vehicle V is equipped with a turret 10. The turret 10 is arranged on top of the vehicle V. The turret 10 is rotatable about an axis Y of rotation orthogonal to the longitudinal extension of the vehicle V and orthogonal to the transversal extension of the vehicle V.

The vehicle V is configured to be equipped with a weapon system S having a weapon 20. The weapon 20 is mounted to the turret 10. The weapon 20 of the weapon system S is thus allowed to rotate by means of rotating the turret 10 about the axis Y.

The weapon 20 is configured to be connected to an elevation device, e.g. a so-called weapon cradle, connected to the turret 10. The elevation device may be any suitable elevation device 30. The weapon 20 is configured to be raised and lowered, i.e. provide an elevation movement, about an elevation axis Z1, illustrated in FIG. 1, by means of the elevation device. The weapon 20 comprises a gun barrel 22. The gun barrel 22 of the weapon 20 is configured to be raised and lowered, i.e. provide an elevation movement, about the elevation axis Z1.

Figure 2:
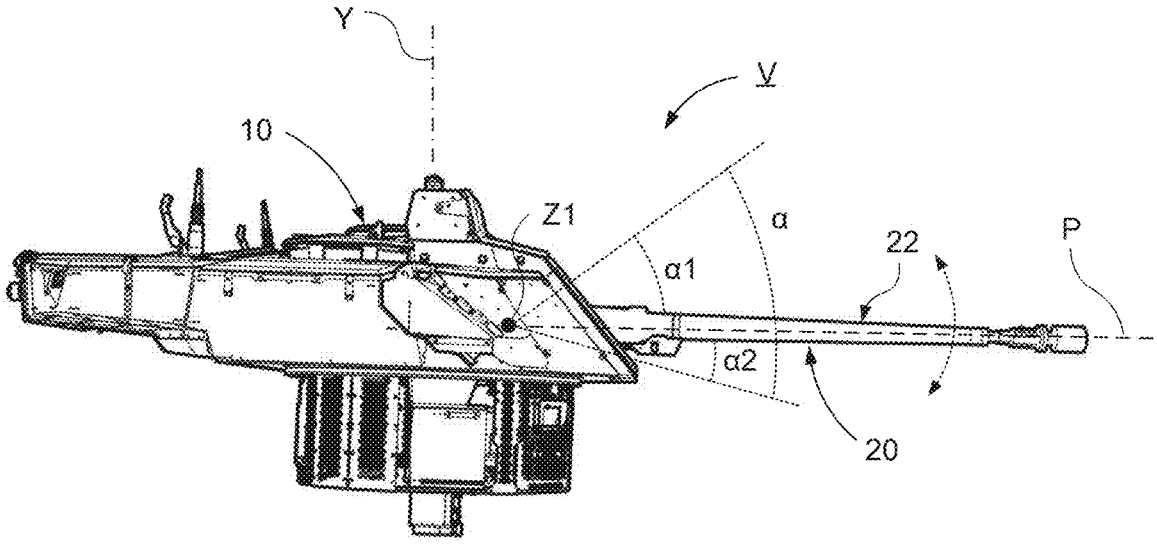
FIG. 2 schematically illustrates a side view of a turret with a weapon system having a weapon according to an embodiment of the present disclosure.

FIG. 2 schematically illustrates a side view of the turret 10 with the weapon system S having a weapon 20 according to an embodiment of the present disclosure.

Figure 3:
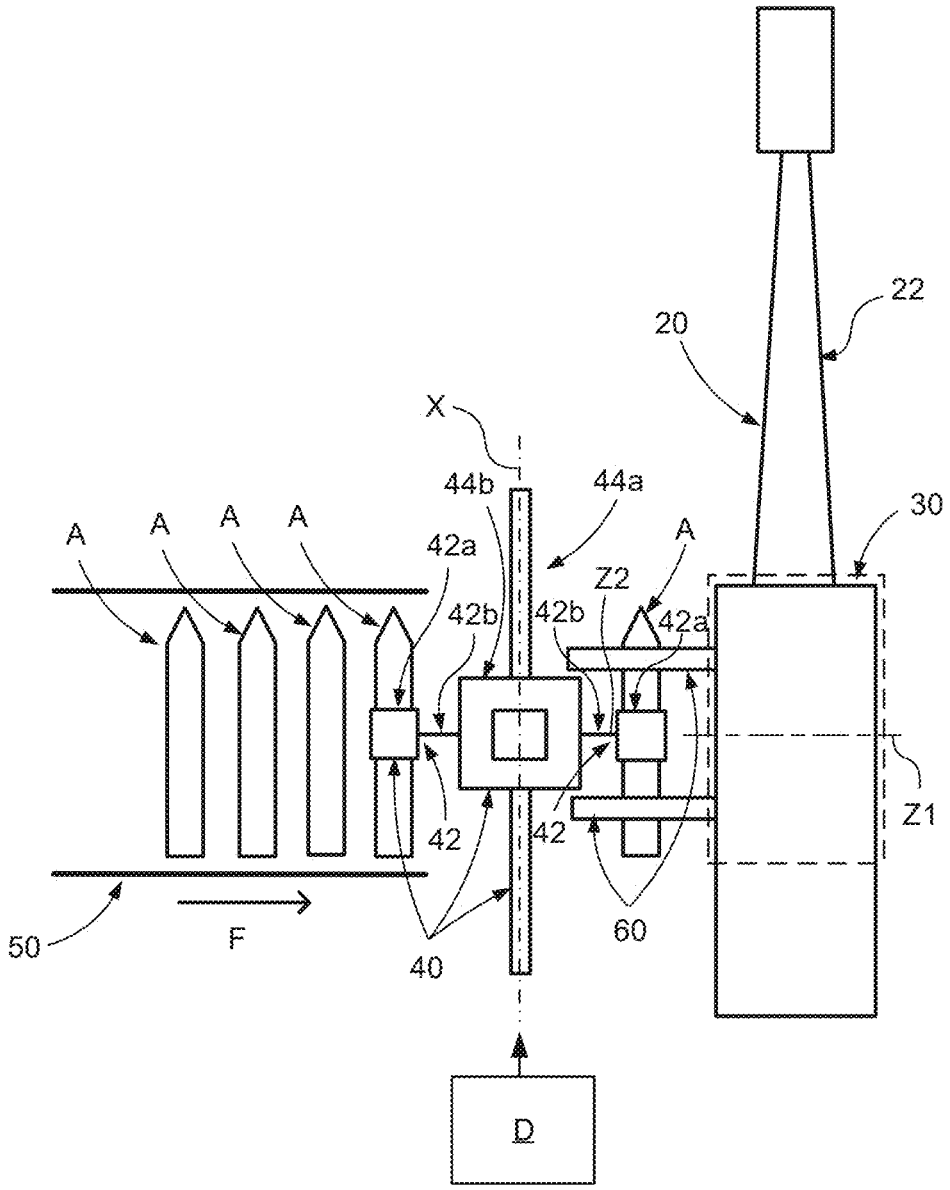
FIG. 3 schematically illustrates a plan view of a weapon, an ammunition channel and an arrangement for feeding ammunition from said channel to said weapon according to an embodiment of the present disclosure.

As mentioned above with reference to FIG. 1, the weapon 20 is configured to be connected to an elevation device, e.g. an elevation device 30 illustrated in FIG. 3. The weapon 20 is configured to be raised and lowered, i.e. provide an elevation movement, about an elevation axis Z1 by means of the elevation device, e.g. weapon cradle.

The weapon 20 is configured to be raised and lowered within an elevation angle $\alpha$. The weapon 20 is configured to be raised from a neutral position P corresponding to the longitudinal extension of the vehicle V, i.e. a horizontal position P when the vehicle is in a horizontal position, an angle $\alpha$1, and lowered from that position an angle $\alpha$2. Said weapon 20 is arranged to be elevated within a range between a maximum elevation angle $\alpha$1 and minimum elevation angle $\alpha$2, the weapon 20 having a neutral non-elevated position P there between, said non-elevated position P corresponding to a horizontal extension of said vehicle.

Here, neutral non-elevated position P of the weapon 20 refers to the position of the weapon and hence the main extension of direction of the weapon 20 corresponding to the longitudinal extension of the vehicle V. Said weapon 20, when elevated about said elevation axis Z1 within said range between said maximum elevation angle and minimum elevation angle, formins an imaginary plane.

Figure 4:
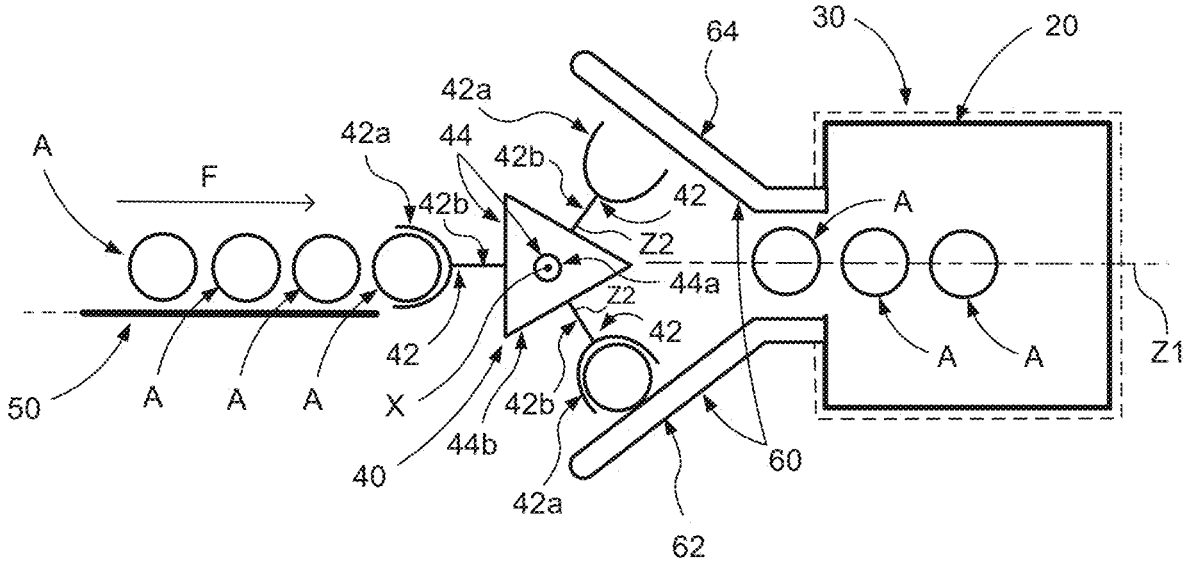
FIG. 4 schematically illustrates a side view of the weapon, ammunition channel and arrangement for feeding ammunition in FIG. 3, according to an embodiment of the present disclosure.
Figure 5:
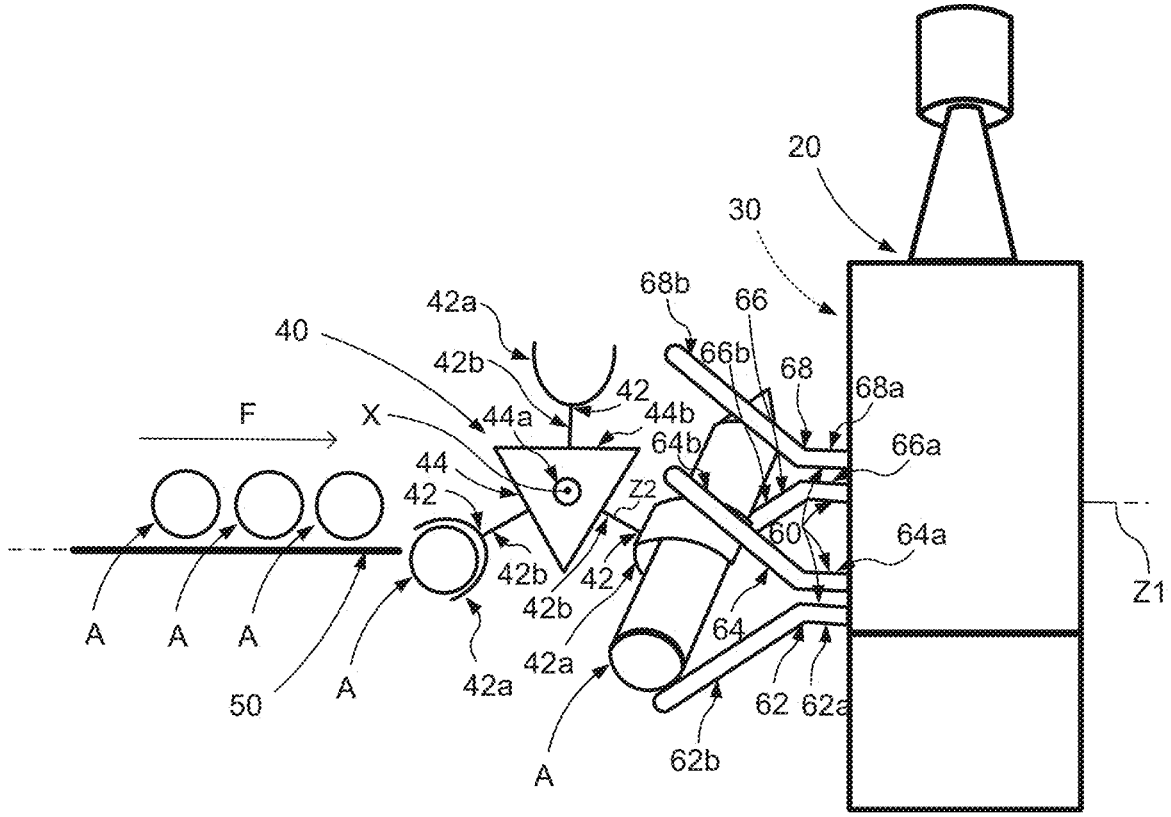
FIG. 5 schematically illustrates a perspective view of the weapon, ammunition channel and arrangement for feeding ammunition in FIG. 3, according to an embodiment of the present disclosure.

FIG. 3 schematically illustrates a plan view, FIG. 4 a side view, and FIG. 5 a perspective view of a weapon 20, an ammunition channel 50 and an arrangement for feeding ammunition A from said ammunition channel 50 to said weapon 20 according to an embodiment of the present disclosure.

FIGS. 3, 4 and 5 schematically illustrates an arrangement for feeding ammunition A from said ammunition channel 50 to said weapon 20 according to an embodiment of the present disclosure.

Said arrangement for feeding ammunition A from said ammunition channel 50 to said weapon 20 comprises a feeding device 40.

According to an aspect of the present disclosure, said ammunition channel 50 is comprised in a guiding arrangement configured to guide the ammunition from an ammunition magazine, not shown, in said ammunition channel 50 to the feeding device 40.

According to an aspect of the present disclosure, said ammunition channel 50 is so called non-linked ammunition channel 50 configured to feed non-linked ammunition A to the feeding device 40.

The, not shown, ammunition magazine may have any suitable configuration for housing ammunition.

Said ammunition A has a longitudinal configuration. Said ammunition A has a front side and a rear side.

The ammunition channel 50 may, according to an aspect of the present disclosure, have a twisted configuration so as to guide the ammunition A from an essentially upright position in the magazine and to an essentially lying position at the feeding device 40. Here, lying position refers to an essentially horizontal position when the ammunition channel 50 is arranged at horizontal ground. Said ammunition A has a main direction of extension.

The ammunition channel 50 may, according to an aspect of the present disclosure, have a configuration so as to guide the ammunition A to a position having an angle relative to an essentially lying position at the feeding device 40. Here, the feeding device 40 may be arranged with a corresponding angle, see e.g. FIG. 10.

According to an aspect of the present disclosure, the individual rounds of the ammunition A configured to be guided in the ammunition channel 50 are separated, i.e. not linked together.

The weapon may comprise any suitable ammunition mechanism, not shown.

The elevation device 30 may be configured to be connected to a bearing support member so as to facilitate said elevation movement by means of the elevation device 30. The elevation device 30 may be configured to be connected to a bearing support member of a turret so as to facilitate said elevation movement by means of the elevation device 30.

The elevation device 30 is arranged to allow elevation movement of a weapon, e.g. a weapon 20 as described with reference to FIGS. 1 and 2. The elevation device 30 is arranged to allow elevation movement of a weapon about an elevation axis Z1. The elevation movement of the weapon 20 is a movement relative to said ammunition channel 50.

The elevation device 30 is according to an aspect of the present disclosure configured to be attached to a turret, e.g. a turret 10 as described with reference to FIGS. 1 and 2, and thus configured to be rotated with the turret about the axis Y as illustrated in FIG. 1 and FIG. 2.

The elevation device 30 comprises a support member, not shown, for supporting the weapon. The elevation axis Z1 is orthogonal to the axial extension of the gun barrel of the weapon 20.

The elevation device 30 with the support member may be configured to be journaled in bearings for facilitating rotation of the elevation device 30 about the axis Z1 for elevation of the gun barrel of the weapon when supported by the elevation device 30.

The elevation device 30 may thus be configured to be connected to the turret via such bearings so as to facilitate rotation of the elevation device 30 relative to the turret, i.e. about the axis Z1.

The ammunition feeding device 40 is arranged between the ammunition channel 50, from which said ammunition A is guided, and said weapon 20. Said feeding device 40 is arranged to feed ammunition A from said ammunition channel 50 to said weapon 20.

Said feeding device 40 is rotatably arranged about a feeding axis X.

According to an aspect of the present disclosure, as illustrated in FIG. 3-5, said feeding device 40 is rotatably arranged about a feeding axis X essentially orthogonal to said elevation axis Z1. Thus, according to an aspect of the present disclosure, as illustrated in FIG. 3-5, said feeding axis X of said feeding device 40 may have a direction of extension essentially orthogonal to the direction of extension of said elevation axis Z1.

According to the present disclosure, said feeding device 40 has at least one ammunition grip member 42 configured to rotate with said feeding device 40 about said feeding axis X. Said at least one ammunition grip member 42 is rotatably arranged relative to said feeding axis X.

According to an aspect of the present disclosure, said feeding device 40 comprises a grip member support configuration 44 configured to rotate about said feeding axis X and configured to support said at least one ammunition grip member 42. According to the embodiment illustrated in FIG. 3-5, said feeding device 40 comprises three ammunition grip members 42 evenly distributed around said grip member support configuration 44. According to an aspect of the present disclosure, said three grip members 42 are distributed around said grip member support configuration 44 with 120 degrees distribution between them. Herein ammunition grip member 42 of the feeding device 40 is referred to as at least one ammunition grip member 42, since FIG. 3-5 only illustrates an example, and the number of grip members could alternatively be e.g. a single grip member, two grip members, four grip members or more.

According to the present disclosure, said at least one ammunition grip member 42 is configured to rotate with said feeding device 40 about said feeding axis X between an ammunition collection location at said ammunition channel 50 and an ammunition release location at said weapon 20.

According to the present disclosure, said at least one ammunition grip member 42, in connection to passing said ammunition collection location at said ammunition channel 50, is configured to collect ammunition A from said ammunition channel 50.

According to an aspect of the present disclosure, the feeding axis X of said feeding device 40 is configured to have a direction of extension so as to facilitate collection of ammunition A by means of said ammunition grip member 42 at said ammunition collection location.

According to an aspect of the present disclosure, the feeding axis X of said feeding device 40 is configured to have a direction of extension essentially corresponding to the direction of extension of ammunition A at the ammunition collection location, so as to facilitate collection of ammunition A by means of said ammunition grip member 42 at said ammunition collection location.

According to the present disclosure, said at least one ammunition grip member 42, in connection to passing said ammunition release location, is configured to release said collected ammunition A so that it is fed into the weapon 20.

Said arrangement for feeding ammunition A to a weapon 20 is configured such that said at least one ammunition grip member 42 is configured to be rotatably adaptable based on the elevation of said weapon 20 so as to facilitate feeding the ammunition A to the weapon 20 in connection to the ammunition release location independent of elevation of said weapon 20. According to an aspect of the present disclosure, said at least one ammunition grip member 42 is configured to be rotatably adaptable based on the elevation angle of said weapon 20 relative to the direction of extension of said feeding axis X.

Said arrangement for feeding ammunition A to a weapon 20 is configured such that said at least one ammunition grip member 42 is configured to be rotatably adaptable based on the elevation angle of said weapon 20 so that the ammunition, in connection to the ammunition release location, is positioned in accordance with the elevation of the weapon 20.

According to an aspect of the present disclosure, said arrangement is configured such that said at least one ammunition grip member 42 is configured to be rotatably adaptable about an axis Z2 based on the elevation of said weapon 20 so as to facilitate feeding the ammunition A to the weapon 20 in connection to the ammunition release location independent of elevation of said weapon 20.

According to an aspect of the present disclosure, illustrated in FIG. 3-5, said arrangement is configured such that said at least one ammunition grip member 42 is configured to be rotatably adaptable about an axis Z2 orthogonal to said feeding axis X based on the elevation of said weapon 20 so as to facilitate feeding the ammunition A to the weapon 20 in connection to the ammunition release location independent of elevation of said weapon 20.

According to an aspect of the present disclosure, said at least one ammunition grip member 42, if said weapon 20 is elevated, is configured to be subjected to a rotational force based on the elevation angle of the elevation of said weapon 20.

According to an aspect of the present disclosure, said at least one ammunition grip member 42, if said weapon 20 is elevated relative to the direction of extension of said feeding axis X, is configured to be subjected to a rotational force based on the elevation angle of the elevation of said weapon 20.

According to an aspect of the present disclosure, as illustrated in FIG. 3-5, said at least one ammunition grip member 42, when subjected to such a rotational force based on the elevation angle of the elevation of said weapon 20, is configured to be rotated about an axis Z2 orthogonal to said feeding axis X from a neutral non-rotated position at said ammunition collection location to a rotated position corresponding to the elevation angle of the elevation of said weapon 20 at said ammunition release location so that the ammunition A to be released and fed into said weapon 20 is positioned in accordance with the elevation of the weapon 20, see e.g. FIG. 5. According to an aspect of the present disclosure, said grip member 42 is configured to be subjected to a rotational force based on the elevation angle of the elevation of said weapon 20 relative to the direction of extension of said feeding axis X so that an ammunition A, having a direction of extension essentially corresponding to the direction of extension of said feeding axis at said collection location, is rotated about said axis Z2 by means of said grip member 42, so that said ammunition A has a direction of extension essentially corresponding to the main direction of extension of the weapon 20, corresponding to the elevation angle of the weapon relative to the direction of extension of said feeding axis X.

According to an aspect of the present disclosure, when said grip member 42 is positioned in the ammunition release location, the direction of extension of said axis Z2 about which said grip member 42 is rotatably arranged is configured to essentially correspond to the direction of extension of said elevation axis Z1. According to an aspect of the present disclosure, when said grip member 42 is positioned in the ammunition release location, the direction of extension of said axis Z2 about which said grip member 42 is rotatably arranged is configured to be essentially aligned with the direction of extension of said elevation axis Z1.

According to an aspect of the present disclosure, said at least one ammunition grip member 42 is resiliently rotatably arranged about said axis Z2 so that said at least one ammunition grip member 42 is maintained in said neutral non-rotated position when not subjected to any rotational force and returns to said neutral non-rotated position when a rotational force to which said at least one ammunition grip member 42 has been subjected is released.

According to an aspect of the present disclosure, said feeding device 40 comprises a grip member support configuration 44. Said grip member support configuration 44 is configured to rotate about said feeding axis X. According to an aspect of the present disclosure, said grip member support configuration 44 is configured to support said at least one ammunition grip member 42.

According to an aspect of the present disclosure, as illustrated in FIG. 3-5, said at least one ammunition grip member 42 is connected to said grip member support configuration 44 so that said at least one ammunition grip member 42 is rotatable about an axis Z2 orthogonal to said feeding axis X.

According to an aspect of the present disclosure, as illustrated in FIG. 3-5, said at least one ammunition grip member 42 is configured to protrude from said grip member support configuration 44 so that said at least one ammunition grip member 42 is rotatable about an axis Z2 orthogonal to said feeding axis X.

According to an aspect of the present disclosure, as illustrated in FIG. 3-5, said at least one ammunition grip member 42 is configured to protrude from said grip member support configuration 44 in a radial direction relative to the extension of the feeding axis X.

According to an aspect of the present disclosure, as illustrated in FIG. 3-5, said at least one ammunition grip member 42 is configured to rotate about said feeding axis X in a plane essentially orthogonal to the direction of extension of said feeding axis X.

According to an aspect of the present disclosure, said grip member support configuration 44 comprises a rotation axle 44*a* configured to provide said rotation of said feeding device 40 about said feeding axis X.

According to an aspect of the present disclosure, said arrangement for feeding ammunition A to a weapon 20 comprises or is operably connected to a drive member D arranged to provide said rotation of said feeding device 40. Said drive member D may be any suitable drive member such as an electric drive member, e.g. electric machine, a hydraulic drive member or the like. Said drive member D may is according to an aspect of the present disclosure configured to operate said feeding device 40 based on operation of said ammunition channel 50. Said drive member D is according to an aspect of the present disclosure configured to operate said feeding device 40 and said ammunition channel 50. According to an aspect of the present disclosure, said drive member D is operably connected to said rotation axle 44*a* for providing said rotation of said feeding device 40 about said feeding axis X.

According to an aspect of the present disclosure, said grip member support configuration 44 comprises a support member 44*b* connected to said rotation axle 44*a* and configured to support said at least one ammunition grip member 42.

According to an aspect of the present disclosure, said at least one ammunition grip member 42 is resiliently connected to said grip member support configuration 44 so that said at least one ammunition grip member is held in a neutral non-rotated position associated with said axis Z2 when not subjected to any rotational force for rotation about said axis Z2 and so that said at least one grip member 42 returns to said neutral non-rotated position when a rotational force having resulted in a rotation of said at least one ammunition grip member 42 to a rotational position about said axis Z2 is released.

According to an aspect of the present disclosure, said at least one ammunition grip member 42 comprises a grip portion 42*a* configured to collect and release ammunition.

According to an aspect of the present disclosure, said at least one ammunition grip member 42 comprises a connection member 42*b* configured to connect said grip portion 42*a* to said grip member support configuration 44 so as allow rotation about said feeding axis X and so as to facilitate said resilient connection of said at least one ammunition grip member 42 to said grip member support configuration 44.

According to an aspect of the present disclosure, said at least one ammunition grip member 42 comprises a spring member, not shown, configured to be operably connected to said connection member 42*b* so as to facilitate said resilient connection of said at least one ammunition grip member 42 to said grip member support configuration 44 via said connection member 42*b*.

According to an aspect of the present disclosure, said connection member 42*b* is configured as a bar or shaft. According to an aspect of the present disclosure, said connection member 42*b* is arranged to project from said grip member support configuration 44 in a radial direction relative to said feeding axis X.

According to an aspect of the present disclosure, said connection member 42*b* has a first end portion configured to be connected to said grip member support configuration 44 and an opposite second end portion configured to be connected to said grip portion 42*a*.

According to an aspect of the present disclosure, said connection member 42*b* is resiliently connected to said grip member support configuration 44 so as allow rotation about said axis Z2 and configured to support said grip portion. According to an aspect of the present disclosure, said at least one ammunition grip member 42 comprises a spring member, not shown, configured to be operably connected to said connection member 42*b* in connection to said grip member support configuration 44.

According to an aspect of the present disclosure, said connection member 42*b* is fixedly connected to said grip member support configuration 44 and resiliently connected to said grip portion 42*a* so as allow rotation of said grip portion about said axis Z2 relative to said connection member 42*b*. According to an aspect of the present disclosure, said at least one ammunition grip member 42 comprises a spring member, not shown, configured to be operably connected to said connection member 42*b* in connection to said grip portion 42*a*.

According to an aspect of the present disclosure, said arrangement further comprises a grip member rotation arrangement 60 configured to rotatably adapt said at least one ammunition grip member 42 based on the elevation of said weapon 20.

According to an aspect of the present disclosure, said grip member rotation arrangement 60 comprises a steering arm configuration 60 fixedly attached to a portion of said weapon 20 and/or a portion of said elevation device 30 arranged to face said feeding device 40. Said steering arm configuration 60 is thus fixedly attached to a side of said weapon 20/elevation device 30 arranged to face said feeding device 40. According to an aspect of the present disclosure, said steering arm configuration 60 is fixedly attached to said weapon 20 and/or elevation device 30 arranged to face said feeding device 40 so that said at least one ammunition grip member 42, when having collected an ammunition A and rotating about said feeding axis X towards said ammunition release location, is configured to be rotated by means of said steering arm configuration 60 based on the elevation of said weapon 20.

According to an aspect of the present disclosure, said steering arm configuration 60 comprises a set of arms 62, 64, 66, 68 arranged so that, when said at least one ammunition grip member 42 has collected an ammunition A and is rotating about said feeding axis X towards said ammunition release location, said collected ammunition A is brought into contact with said set of arms 62, 64, 66, 68 so that said ammunition grip member 42 carrying said ammunition A is rotated based on the elevation of said weapon 20.

If said weapon 20 is in a non-elevated position, said ammunition grip member 42 carrying said ammunition A is not subjected to any rotation since the ammunition A is correctly positioned relative to the weapon 20 in said ammunition release location.

According to an aspect of the present disclosure, said set of arms 62, 64, 66, 68 are arranged so that, when said at least one ammunition grip member 42 has collected an ammunition A and is rotating about said feeding axis X towards said ammunition release location, said collected ammunition A is brought into contact with said set of arms 62, 64, 66, 68 so that said ammunition grip member 42 carrying said ammunition A is guided towards said ammunition release location even when said weapon 20 is in a non-elevated position.

According to an aspect of the present disclosure, said set of arms 62, 64, 66, 68 comprises a first pair of arms 62, 64 arranged in connection to the side of the weapon 20 facing said feeding device 40. According to an aspect of the present disclosure, said set of arms 62, 64, 66, 68 comprises a second pair of arms 66, 68 arranged in connection to the side of the weapon 20 facing said feeding device 40 at a distance from said first pair of arms, closer to the side from which said gun barrel 22 of said weapon 20 is projecting. When said weapon is in a horizontal position, said first pair of arms 62, 64 and said second pair of arms 66, 68 are arranged at essentially the same horizontal level.

Said first pair of arms 62, 64 comprises a lower arm 62 and upper arm 64, said lower arm 62 being arranged below said upper arm 64. Said second pair of arms 66, 68 comprises a lower arm 66 and upper arm 68, said lower arm 66 being arranged below said upper arm 68.

According to an aspect of the present disclosure, said lower arm 62 and upper arm 64 of the first pair of arms 62, 64 and said lower arm 66 and upper arm 68 of the second pair of arms 66, 68 has a first arm portion 62*a*, 64*a*; 66*a*, 68*a* arranged in connection to said weapon 20 and projecting in a direction parallel to the elevation axis Z1 towards said feeding device 40. Said first arm portion 62*a*, 64*a*; 66*a*, 68*a* of said lower and upper arm of the respective arm pair 62, 64; 66, 68 are arranged at a distance from each other so as to allow an ammunition A to be introduced in connection to the ammunition release position into the weapon 20.

According to an aspect of the present disclosure, said lower arm 62 and upper arm 64 of the first pair of arms 62, 64 and said lower arm 66 and upper arm 68 of the second pair of arms 66, 68 has a second arm portion 62*b*, 64*b*; 66*b*, 68*b* projecting from said first arm portion 62*a*, 64*a*; 66*a*, 68*a* towards said feeding device, in a direction so that the second arm portion 62*b*, 66*b* of the lower arm 62, 66 projects downwardly with an angle relative to the extension of its first arm portion 62*a*, 66*a* and the second arm portion 64*b*, 68*b* of the upper arm 64, 68 projects upwardly with an angle relative to the extension of its first arm portion 64*a*, 68*a* forming a receiving and guiding configuration for receiving and guiding said ammunition A when it is rotated towards said ammunition release location, and so that said ammunition grip member 42 carrying said ammunition A is rotated based on the elevation of said weapon 20.

According to an aspect of the present disclosure, said steering arm configuration 60 is configured to be fixedly attached to said elevation device 30. According to an aspect of the present disclosure, said set of arms 62, 64, 66, 68 of said steering arm configuration 60 are configured to be fixedly attached to said elevation device 30.

Figure 6:
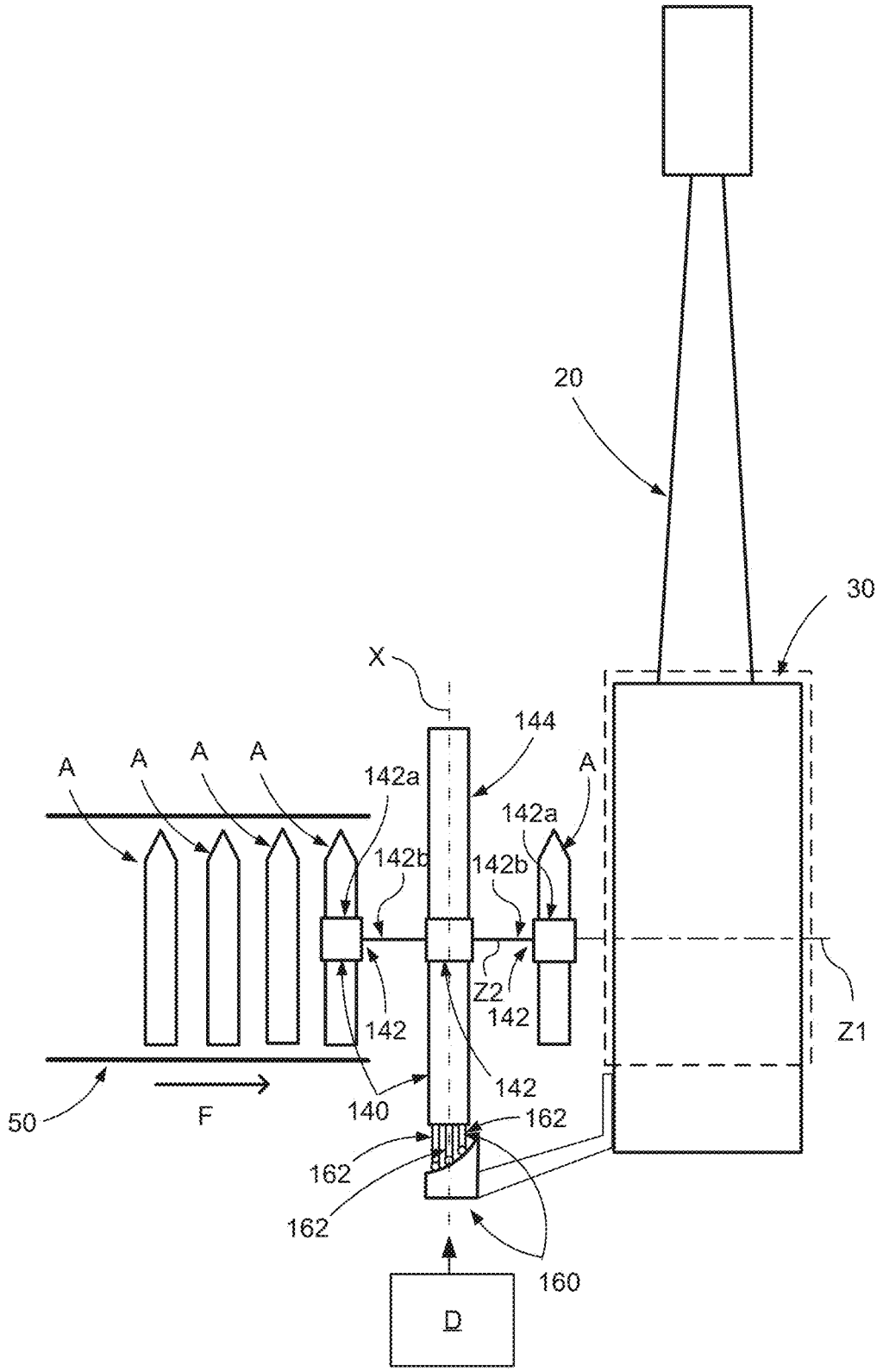
FIG. 6 schematically illustrates a plan view of a weapon, an ammunition channel and an arrangement for feeding ammunition from said channel to said weapon according to another embodiment of the present disclosure.
Figure 7A:
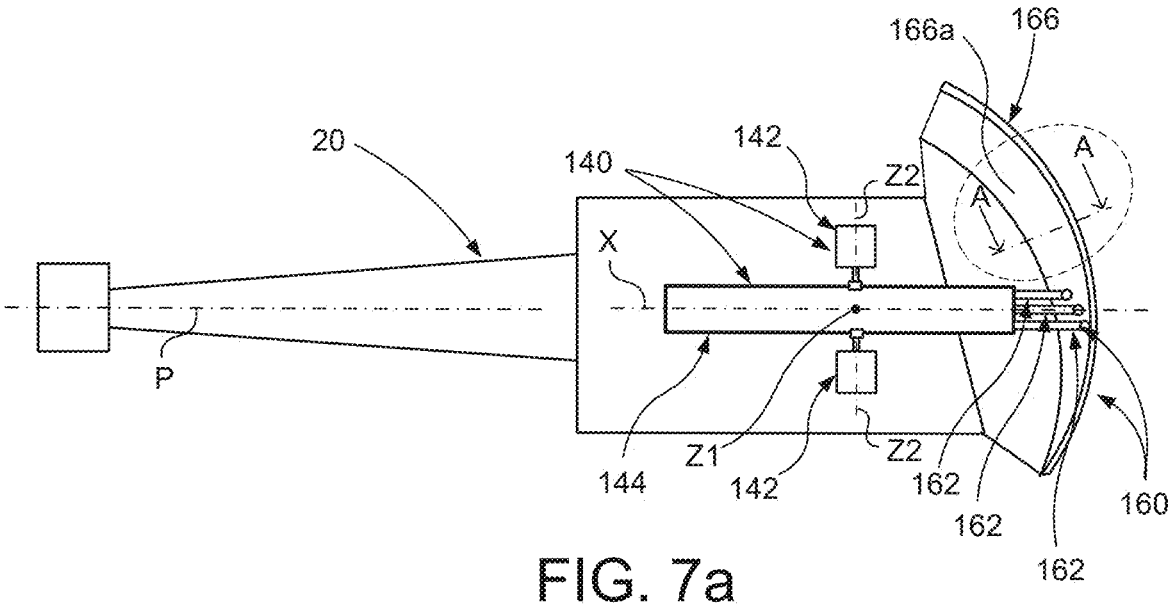
FIG. 7*a* schematically illustrates a side view of the weapon and arrangement for feeding ammunition in FIG. 6, according to an embodiment of the present disclosure.

FIG. 6 schematically illustrates a plan view of a weapon 20, an ammunition channel 50 and an arrangement for feeding ammunition A from said channel 50 to said weapon 20 according to another embodiment of the present disclosure. FIG. 7*a* schematically illustrates a side view of the weapon 20 and arrangement for feeding ammunition A in FIG. 6. Said arrangement for feeding ammunition from said ammunition channel 50 to said weapon 20 comprises a feeding device 140 illustrated in FIGS. 6 and 7*a* and in a perspective view in FIG. 8.

The weapon 20 and ammunition channel 50 disclosed in FIG. 6 essentially correspond to the weapon 20 and ammunition channel 50 disclosed in FIG. 3-5.

As mentioned above with reference to FIG. 1, the weapon 20 may be configured to be connected to an elevation device, e.g. an elevation device 30 illustrated in FIG. 3. The weapon 20 is configured to be raised and lowered, i.e. provide an elevation movement, about an elevation axis Z1 by means of the elevation device 30, e.g. weapon cradle.

The ammunition feeding device 140 is arranged between the ammunition channel 50, from which said ammunition A is guided, and said weapon 20. Said feeding device 140 is arranged to feed ammunition A from said ammunition channel 50 to said weapon 20, see FIG. 6.

Said feeding device 140 is rotatably arranged about a feeding axis X.

According to an aspect of the present disclosure, as illustrated in e.g. FIG. 6, Said feeding device 140 is rotatably arranged about a feeding axis X orthogonal to said elevation axis Z1. Thus, according to an aspect of the present disclosure, as illustrated in e.g. FIG. 6, said feeding axis X of said feeding device 140 may have a direction of extension essentially orthogonal to the direction of extension of said elevation axis Z1.

According to the present disclosure, said feeding device 140 has at least one ammunition grip member 142 configured to rotate with said feeding device 140 about said feeding axis X. Said at least one ammunition grip member 142 is rotatably arranged relative to said feeding axis X.

According to an aspect of the present disclosure, said feeding device 140 has an elongated configuration. According to an aspect of the present disclosure, said feeding device 140 has a hollow configuration comprising an inner space.

According to an aspect of the present disclosure, said feeding device 140 comprises a grip member support configuration 144 configured to rotate about said feeding axis X and configured to support said at least one ammunition grip member 142. According to the embodiment illustrated in FIGS. 6 and 8, said feeding device 140 comprises three ammunition grip members 142 evenly distributed around said grip member support configuration 144. According to an aspect of the present disclosure, said three grip members 142 are distributed around said grip member support configuration 144 with 120 degrees distribution between them. Herein ammunition grip member 142 of the feeding device 140 is referred to as at least one ammunition grip member 142, since FIGS. 6 and 8 only illustrates an example, and the number of grip members could alternatively be e.g. a single grip member, two grip members, four grip members or more.

According to the present disclosure, said at least one ammunition grip member 142 is configured to rotate with said feeding device 140 about said feeding axis X between an ammunition collection location at said ammunition channel 50 and an ammunition release location at said weapon 20.

According to the present disclosure, said at least one ammunition grip member 142, in connection to passing said ammunition collection location at said ammunition channel 50, is configured to collect ammunition A from said ammunition channel 50.

According to an aspect of the present disclosure, the feeding axis X of said feeding device 140 is configured to have a direction of extension so as to facilitate collection of ammunition A by means of said ammunition grip member 142 at said ammunition collection location.

According to an aspect of the present disclosure, the feeding axis X of said feeding device 140 is configured to have a direction of extension essentially corresponding to the direction of extension of ammunition A at the ammunition collection location, so as to facilitate collection of ammunition A by means of said ammunition grip member 142 at said ammunition collection location.

According to the present disclosure, said at least one ammunition grip member 142, in connection to passing said ammunition release location, is configured to release said collected ammunition A so that it is fed into the weapon 20.

Said arrangement for feeding ammunition A to a weapon 20 is configured such that said at least one ammunition grip member 142 is configured to be rotatably adaptable based on the elevation of said weapon 20 so as to facilitate feeding the ammunition A to the weapon 20 in connection to the ammunition release location independent of elevation of said weapon 20. According to an aspect of the present disclosure, said at least one ammunition grip member 142 is configured to be rotatably adaptable based on the elevation angle of said weapon 20 relative to the direction of extension of said feeding axis X.

Said arrangement for feeding ammunition A to a weapon 20 is configured such that said at least one ammunition grip member 142 is configured to be rotatably adaptable based on the elevation angle of said weapon 20 so that the ammunition A, in connection to the ammunition release location, is positioned in accordance with the elevation of the weapon 20.

According to an aspect of the present disclosure, said arrangement is configured such that said at least one ammunition grip member 142 is configured to be rotatably adaptable about an axis Z2 based on the elevation of said weapon 20 so as to facilitate feeding the ammunition A to the weapon 20 in connection to the ammunition release location independent of elevation of said weapon 20.

According to an aspect of the present disclosure, illustrated in e.g. FIG. 6, said arrangement is configured such that said at least one ammunition grip member 142 is configured to be rotatably adaptable about an axis Z2 orthogonal to said feeding axis X based on the elevation of said weapon 20 so as to facilitate feeding the ammunition A to the weapon 20 in connection to the ammunition release location independent of elevation of said weapon 20.

According to an aspect of the present disclosure, said at least one ammunition grip member 142, if said weapon 20 is elevated relative to the direction of extension of said feeding axis X, is configured to be subjected to a rotational force based on the elevation angle of the elevation of said weapon 20.

According to an aspect of the present disclosure, said at least one ammunition grip member 142, when subjected to such a rotational force based on the elevation angle of the elevation of said weapon 20, is configured to be rotated about an axis Z2 orthogonal to said feeding axis X from a neutral non-rotated position at said ammunition collection location to a rotated position corresponding to the elevation angle of the elevation of said weapon 20 at said ammunition release location so that the ammunition A to be released and fed into said weapon 20 is positioned in accordance with the elevation of the weapon. According to an aspect of the present disclosure, said grip member 42 is configured to be subjected to a rotational force based on the elevation angle of the elevation of said weapon 20 relative to the direction of extension of said feeding axis X so that an ammunition A, having a direction of extension essentially corresponding to the direction of extension of said feeding axis at said collection location, is rotated about said axis Z2 by means of said grip member 142, so that said ammunition A has a direction of extension essentially corresponding to the main direction of extension of the weapon 20, corresponding to the elevation angle of the weapon relative to the direction of extension of said feeding axis X.

According to an aspect of the present disclosure, when said grip member 142 is positioned in the ammunition release location, the direction of extension of said axis Z2 about which said grip member 142 is rotatably arranged is configured to essentially correspond to the direction of extension of said elevation axis Z1. According to an aspect of the present disclosure, when said grip member 142 is positioned in the ammunition release location, the direction of extension of said axis Z2 about which said grip member 142 is rotatably arranged is configured to be essentially aligned with the direction of extension of said elevation axis Z1.

According to an aspect of the present disclosure, said at least one ammunition grip member 142 is resiliently rotatably arranged about said axis Z2 so that said at least one ammunition grip member 142 is maintained in said neutral non-rotated position when not subjected to any rotational force and returns to said neutral non-rotated position when a rotational force to which said at least one ammunition grip member 142 has been subjected is released.

According to an aspect of the present disclosure, said feeding device 140 comprises a grip member support configuration 144. Said grip member support configuration 144 is configured to rotate about said feeding axis X. According to an aspect of the present disclosure, said grip member support configuration 144 is configured to support said at least one ammunition grip member 142.

According to an aspect of the present disclosure, as illustrated in e.g. FIG. 6, said at least one ammunition grip member 142 is connected to said grip member support configuration 144 so that said at least one ammunition grip member 142 is rotatable about an axis Z2 orthogonal to said feeding axis X.

According to an aspect of the present disclosure, as illustrated in e.g. FIGS. 6 and 7*a*, said at least one ammunition grip member 142 is configured to protrude from said grip member support configuration 144 so that said at least one ammunition grip member 142 is rotatable about an axis Z2 orthogonal to said feeding axis X, see e.g. FIG. 7*a*.

According to an aspect of the present disclosure, as illustrated in e.g. FIGS. 6 and 7*a*, said at least one ammunition grip member 142 is configured to rotate about said feeding axis X in a plane essentially orthogonal to the direction of extension of said feeding axis X.

FIG. 7*a* illustrates a side view of the weapon 20 and arrangement for feeding ammunition A. In FIG. 7*a*, the weapon 20 is in the neutral position P, wherein the main direction of extension of the weapon 20 essentially corresponds to the direction of extension of the feeding axis X of said feeding device 140. The weapon 20, when being in a neutral position P, is here in a non-elevated position relative to the direction of extension of said feeding axis X.

According to an aspect of the present disclosure, as illustrated in FIG. 7*a*, said feeding device 140 is configured to be arranged in connection to said weapon 20 so that the direction of extension of said feeding axis X essentially corresponds to the direction of extension of said weapon 20 in the neutral position.

According to an aspect of the present disclosure, said at least one ammunition grip member 142 is configured to protrude from said grip member support configuration 144 in a radial direction relative to the extension of the feeding axis X. Said axis z2 is thus according to said aspect has a radial extension relative to the extension of the feeding axis X.

According to an aspect of the present disclosure, said grip member support configuration 144 comprises a rotation axle 144*a* configured to provide said rotation of said feeding device 140 about said feeding axis X.

According to an aspect of the present disclosure, said arrangement for feeding ammunition A to a weapon 20 comprises or is operably connected to a drive member D arranged to provide said rotation of said feeding device 140. Said drive member D may be any suitable drive member such as an electric drive member, e.g. electric machine, a hydraulic drive member or the like. Said drive member D may is according to an aspect of the present disclosure configured to operate said feeding device 140 based on operation of said ammunition channel 50. Said drive member D is according to an aspect of the present disclosure configured to operate said feeding device 140 and said ammunition channel 50. According to an aspect of the present disclosure, said drive member D is operably connected to said rotation axle 144*a* for providing said rotation of said feeding device 140 about said feeding axis X.

According to an aspect of the present disclosure, said grip member support configuration 144 comprises a support member 144*b* connected to said rotation axle 144*a* and configured to support said at least one ammunition grip member 142.

According to an aspect of the present disclosure, said at least one ammunition grip member 142 is resiliently connected to said grip member support configuration 144 so that said at least one ammunition grip member is held in a neutral non-rotated position associated with said axis Z2 when not subjected to any rotational force for rotation about said axis Z2 and so that said at least one grip member 142 returns to said neutral non-rotated position when a rotational force having resulted in a rotation of said at least one ammunition grip member 142 to a rotational position about said axis Z2 is released.

According to an aspect of the present disclosure, said at least one ammunition grip member 142 comprises a grip portion 142*a* configured to collect and release ammunition.

According to an aspect of the present disclosure, said at least one ammunition grip member 142 comprises a connection member 142*b* configured to connect said grip portion 142*a* to said grip member support configuration 144 so as allow rotation about said feeding axis X and so as to facilitate said resilient connection of said at least one ammunition grip member 142 to said grip member support configuration 144.

According to an aspect of the present disclosure, said connection member 142*b* is configured as a bar or shaft. According to an aspect of the present disclosure, said connection member 142*b* is arranged to project from said grip member support configuration 144 in a radial direction relative to said feeding axis X. According to an aspect of the present disclosure, said projection of said connection member essentially corresponds to the extension of said axis Z2.

According to an aspect of the present disclosure, said connection member 142*b* has a first end portion configured to be connected to said grip member support configuration 144 and an opposite second end portion configured to be connected to said grip portion 142*a*.

According to an aspect of the present disclosure, said connection member 142*b* is resiliently connected to said grip member support configuration 144 so as allow rotation about said axis Z2 and configured to support said grip portion 142*a*.

According to an aspect of the present disclosure, said arrangement for feeding ammunition shown in e.g. FIG. 6 further comprises a grip member rotation arrangement configured to rotatably adapt said at least one ammunition grip member 142 based on the elevation of said weapon 20.

According to an aspect of the present disclosure, said grip member rotation arrangement comprises an axle configuration 160, see e.g. FIG. 6 and FIG. 7*a*. Said axle configuration 160 is configured such that, when said grip member 142 is rotating about said feeding axis X towards said ammunition release location, an axial movement in the axial direction of the feeding axis X is provided based on the elevation of said weapon 20, wherein said axial movement is transferred to a rotational movement of said grip member 142 so that said ammunition grip member 142 is rotated based on the elevation of said weapon 20.

Figure 7B:
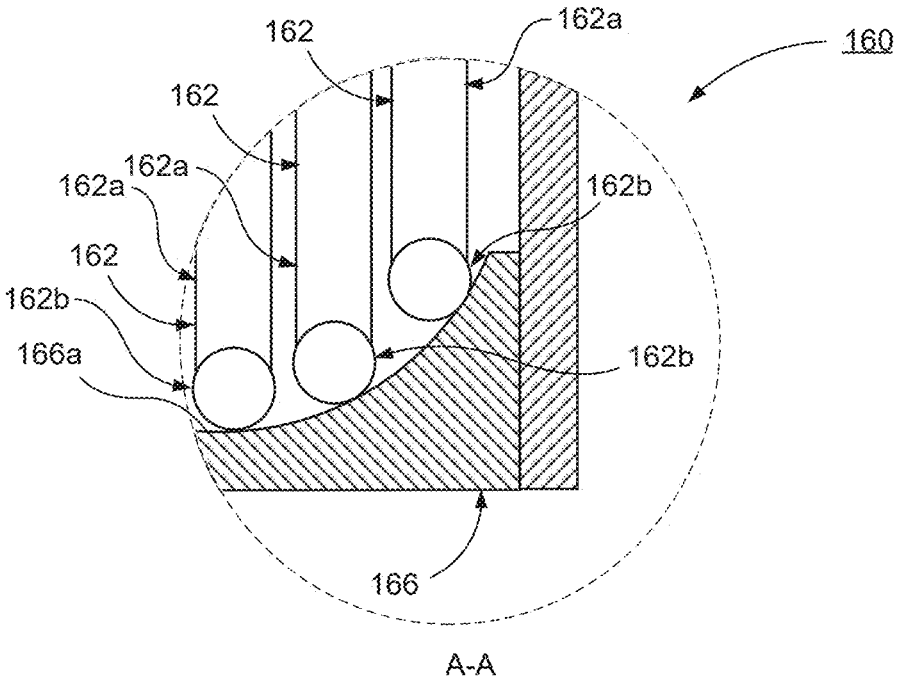
FIG. 7*b* schematically illustrates a cross sectional view of an axle configuration of the arrangement for feeding ammunition in FIG. 7*a*, according to an embodiment of the present disclosure.

FIG. 7*b* schematically illustrates a cross sectional view of a portion of said axle configuration 160 of the arrangement for feeding ammunition in FIG. 7*a*, according to an embodiment of the present disclosure.

Figure 8:
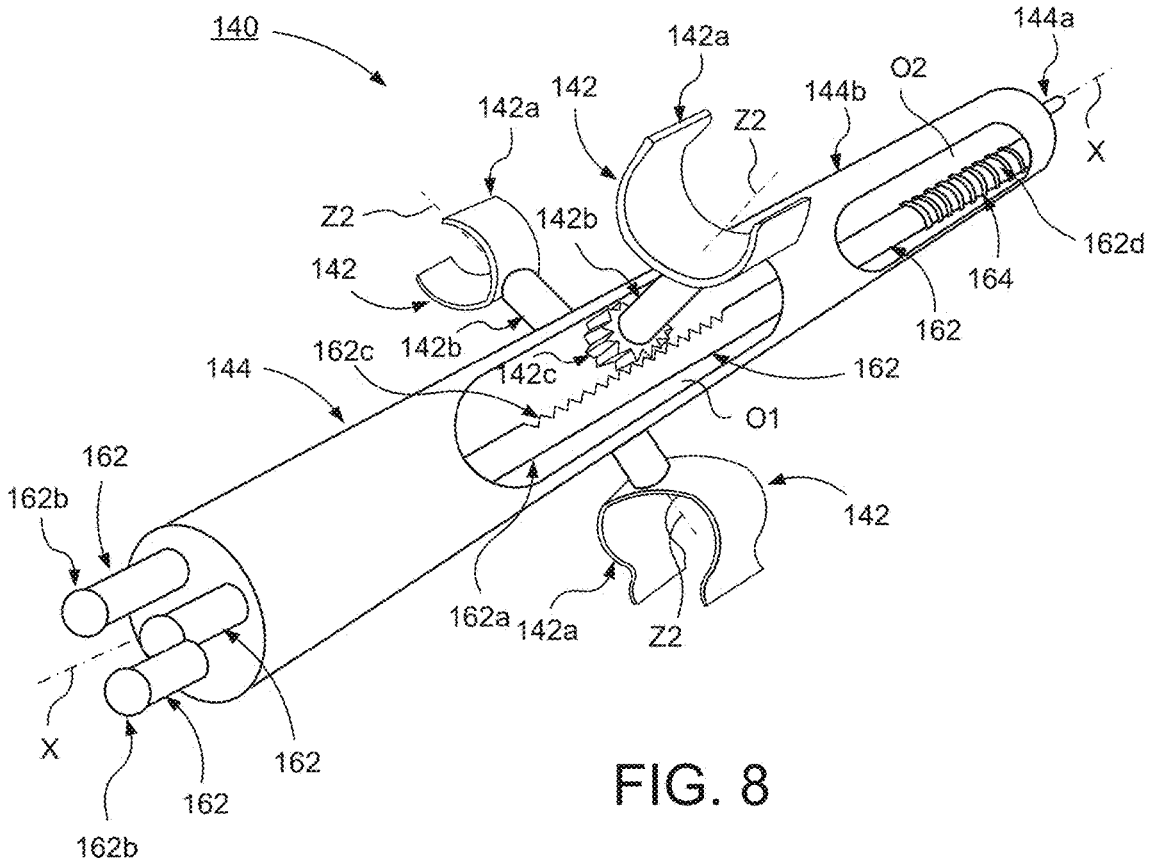
FIG. 8 schematically illustrates a perspective view of a feeding device of the arrangement for feeding ammunition in FIG. 6, according to an embodiment of the present disclosure; and, FIG. 9 schematically illustrates a cross sectional view of the feeding device of in FIG. 8, according to an embodiment of the present disclosure.
Figure 9:
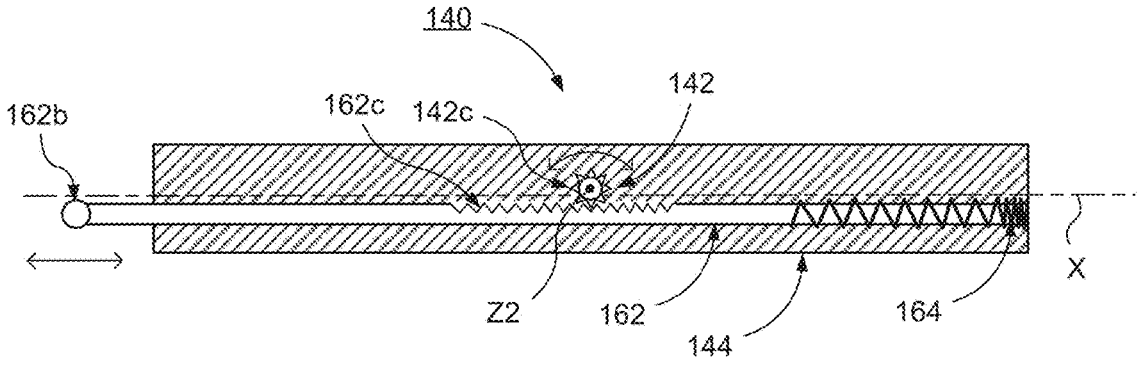

FIG. 8 schematically illustrates a perspective view of a feeding device 140 of the arrangement for feeding ammunition according to an aspect of the present disclosure; and FIG. 9 schematically illustrates a cross sectional view of the feeding device 140 in FIG. 8.

According to an aspect of the present disclosure, said axle configuration 160 comprises a bar member 162 for each of said at least one grip member 142 and a bar member contactor 166 fixedly attached to or integrated with said weapon 20 and/or elevation device 30, see e.g. FIG. 6 and FIG. 7*a*.

Said at least one bar member 162 has an axial extension parallel to the feeding axis X. Said at least one bar member 162 has a longitudinal extension and is configured to extend in a direction parallel to the feeding axis X. Said at least one bar member 162 is configured to rotate with said feeding device 140 about said feeding axis X. Said at least one bar member 162 is configured to be arranged so that it is prevented from rotating about its own axis. Said at least one bar member 162 is configured to be arranged in connection to said grip member support configuration 144 so that it remains at the same distance relative to said feeding axis X during said rotation about said feeding axis X. According to an aspect of the present disclosure, at least a portion of said at least one bar member 162 is configured to run within an inner space of said feeding device 140, parallel to the feeding axis X.

According to an aspect of the present disclosure, when said grip member 142 is rotating about said feeding axis X towards said ammunition release location, said bar member 162 is configured to be brought into contact with said bar member contactor 166 providing a force so that said bar member 162 is moved in the axial direction of the feeding axis X based on the elevation of said weapon 20.

Thus, said bar member 162, when said grip member 142 is rotating about said feeding axis X towards said ammunition release location and said weapon is in an elevated position, is configured to be brought into contact with said bar member contactor 166 so that said contact results in a force against said bar member 162 so that said bar member 162 is moved in the axial direction of the feeding axis X based on the elevation of said weapon 20.

According to an aspect of the present disclosure, when said weapon is in a non-elevated position, no axial movement of said bar member is provided.

According to an aspect of the present disclosure, said bar member 162 is arranged in connection to said grip member 142 so that said axial movement is transferred to said rotational movement of said grip member 142 so that said ammunition grip member 142 is rotated based on the elevation of said weapon 20.

According to an aspect of the present disclosure, said at least one bar member 162 has an end portion 162*b* configured to be brought in contact with a curved surface portion 166*a* of said bar member contactor 166 so as to facilitate providing said force so that said bar member 162 is moved in the axial direction of the feeding axis X based on the elevation of said weapon 20.

According to an aspect of the present disclosure, said at least one bar member 162 has a bar engagement portion 162*c*, and said at least one grip member 142 has rotation engagement portion 142*c*.

According to an aspect of the present disclosure, said bar engagement portion 162*c* of a bar member 162 is configured to be engaged with said rotation engagement portion 142*c* of a grip member 142 such that, when said grip member 142 is rotating about said feeding axis X towards said ammunition release location so that said bar member 162 is moved in the axial direction of the feeding axis X based on the elevation of said weapon 20, said axial movement is transferred to said rotational movement of said grip member 142 by means of the engagement between said bar engagement portion 162*c* and said rotation engagement portion 142*c*. This is schematically illustrated in FIG. 8, where a cut-out of the outer structure of the feeding device 140 in the shape of an opening O1 is shown for illustrative purposes in order to show the rotation engagement portion 142*c* and bar engagement portion 162*c*, which, according to an aspect, are configured to be arranged within a space of said feeding device 140.

Said rotation engagement portion 142*c* of said at least one grip member 142 is arranged in connection to a portion of said connection member 142*b* being arranged at said grip member support configuration 144. According to an aspect of the present disclosure, said rotation engagement portion 142*c* comprises a sprocket member arranged in connection to said portion of said connection member 142*b*, arranged at said grip member support configuration 144. According to an aspect of the present disclosure, said sprocket member of said rotation engagement portion 142*c* is arranged about said portion of said connection member 142*b*. According to an aspect of the present disclosure, said sprocket member of said rotation engagement portion 142*c* is arranged around an end portion of said bar shaped connection member 142*b*.

According to an aspect of the present disclosure, said bar engagement portion 162*c* comprises engagement teeth distributed along a portion of said at least one bar member 162. According to an aspect of the present disclosure, said sprocket member of said rotation engagement portion 142*c* comprises engagement teeth configured to engage with said engagement teeth of said bar engagement portion 162*c* so as to facilitate transfer of axial movement of said bar member 162 to said rotational movement of said grip member 142 when said grip member 142 is rotating about said feeding axis X towards said ammunition release location so that said bar member 162 is moved in the axial direction of the feeding axis X based on the elevation of said weapon 20.

According to an aspect of the present disclosure, said at least one bar member 162 is resiliently arranged so that said at least one grip member 142 is maintained in said neutral non-rotated position when a bar member 162 associated with that grip member 142 is not subjected to a force and thus is not moved in its axial direction, and so that said at least one grip member 142 is returned to said neutral non-rotated position when a force to which said at least one bar member 162 has been subjected, having moved said bar member 162 in its axial direction and transferred said force to said grip member 142 so that said grip member 142 has been rotated to a rotated position is released.

Thus, said at least one ammunition grip member 142 is resiliently arranged via a bar member 142 of said at least one bar member 162 associated with that grip member 142. Thus, said at least one ammunition grip member 142 is resiliently rotatably arranged about said axis Z2 via a bar member 162 of said at least one bar member 162 associated with that grip member 142 so that said at least one ammunition grip member 142 is maintained in said neutral non-rotated position when not subjected to any rotational force and returns to said neutral non-rotated position when a rotational force to which said at least one ammunition grip member 142 has been subjected is released.

According to an aspect of the present disclosure, said axle configuration 160 comprises a spring member 164 for each of said at least one a bar member 162 so as to provide said resilient arrangement of said at least one bar member 162.

Said spring member 164 may be any suitable spring member for providing said resilient arrangement of said at least one bar member 162. Said spring member 164 is according to an aspect of the present disclosure a coil spring member.

Said spring member 164 is, according to an aspect of the present disclosure, connected to said at least one bar member 162 so that said at least one bar member 162 is maintained in a neutral non-moved position when not subjected to any rotational force, allows movement, with spring resistance, in its axial direction when said bar member is subjected to a force in that direction, and returns with axial movement in its axial direction to said neutral non-moved position when an axial force to which said at least one bar member 162 has been subjected is released.

Said spring member 164 is, according to an aspect of the present disclosure, connected to said at least one bar member 162 and to said grip member support configuration 144 so that said at least one bar member 162 is maintained in a neutral non-moved position when not subjected to any rotational force, allows movement, with spring resistance, in its axial direction when said bar member 162 is subjected to a force in that direction, and returns with axial movement in its axial direction to said neutral non-moved position when an axial force to which said at least one bar member 162 has been subjected is released.

Said at least one bar member 162 has an end portion 162*d* opposite to said end portion 162*b*. According to an aspect of the present disclosure, said spring member 164 is configured to be arranged in connection to said end portion 162*d* and a portion of said grip member support configuration 144. According to an aspect of the present disclosure, said spring member 164, e.g. coil spring member, is configured to be arranged around said end portion 162*d*. This is schematically illustrated in FIG. 8, where a cut-out of the outer structure of the feeding device 140 in the shape of an opening O2 is shown for illustrative purposes in order to show the spring member 164 arranged about said end portion 162*d* of said bar member 162, which, according to an aspect, are configured to be arranged within a space of said feeding device 140.

Figure 10:
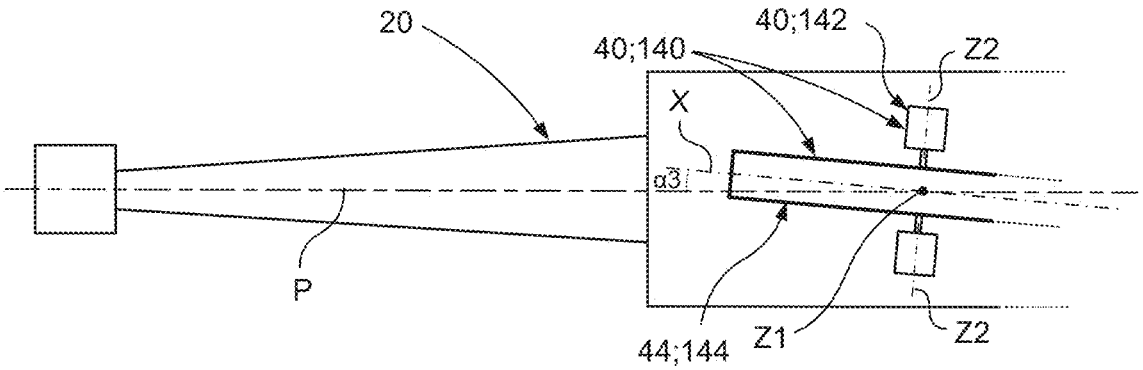
FIG. 10 schematically illustrates a side view of a weapon and a feeding device of an arrangement for feeding ammunition, according to an embodiment of the present disclosure; and, FIG. 11 schematically illustrates a plan view of a weapon, an ammunition channel and an arrangement for feeding ammunition from said channel to said weapon according to an embodiment of the present disclosure.

FIG. 10 schematically illustrates a side view of a weapon 20 and a feeding device 40; 140 of an arrangement for feeding ammunition, according to an aspect of the present disclosure. Said feeding device 40; 140 may be any suitable feeding device. Said feeding device 40; 140 may be associated with a feeding device 40 according to FIG. 3-5. Said feeding device 40; 140 may be associated with a feeding device 140 according to FIGS. 6, 7*a* and 8.

In FIG. 10, the weapon is in the neutral position P so that the main direction of extension of the weapon 20 is essentially horizontal when arranged in connection to horizontal ground. With regard to the direction of extension of said feeding axis X of said feeding device 40; 140, FIG. 10 differs from e.g. FIG. 7*a* in that said feeding device is arranged so that, when said weapon 20 is in the neutral position P, there is an elevation angle $\alpha$3 of said weapon 20 relative to the direction of extension of said feeding axis X.

According to an aspect of the present disclosure, as illustrated in FIG. 10, said feeding device 40; 140 is configured to be arranged in connection to said weapon 20 so that, when the weapon is in the neutral position, there is an elevation angle of the weapon 20 relative to the direction of extension of said feeding axis X.

In the embodiment illustrated in FIG. 10, said at least one ammunition grip member 42; 142 is configured to be subjected to a rotational force based on said elevation angle $\alpha 3$ of said weapon 20 relative to the direction of extension of said feeding axis X, when said weapon 20 is in its neutral position P so that said at least one ammunition grip member 42; 142 is rotated about said axis Z2 from a neutral non-rotated position at said ammunition collection location to a rotated position corresponding to that elevation angle of the elevation of said weapon 20 at said ammunition release location so that the ammunition A to be released and fed into said weapon 20 is positioned in accordance with the elevation of the weapon 20, i.e. here the neutral position P of the weapon.

As mentioned above, according to an aspect of the present disclosure, said weapon 20 is arranged to be elevated about said elevation axis Z1 within a range between a maximum elevation angle and minimum elevation angle, wherein the weapon 20 has a neutral position P between said maximum elevation angle and minimum elevation angle, said neutral position corresponding to a horizontal extension of said weapon 20 when the arrangement comprising the elevation device is arranged at horizontal ground, e.g. when said arrangement is comprised in a weapon system mounted on a vehicle standing on horizontal ground, as illustrated in e.g. FIGS. 1 and 2. Said feeding device may be arranged in connection to said weapon so that the direction of extension of said feeding axis has any suitable angle relative to the neutral position of said weapon, i.e. relative to the main direction of extension of the weapon in the neutral position.

Figure 11:
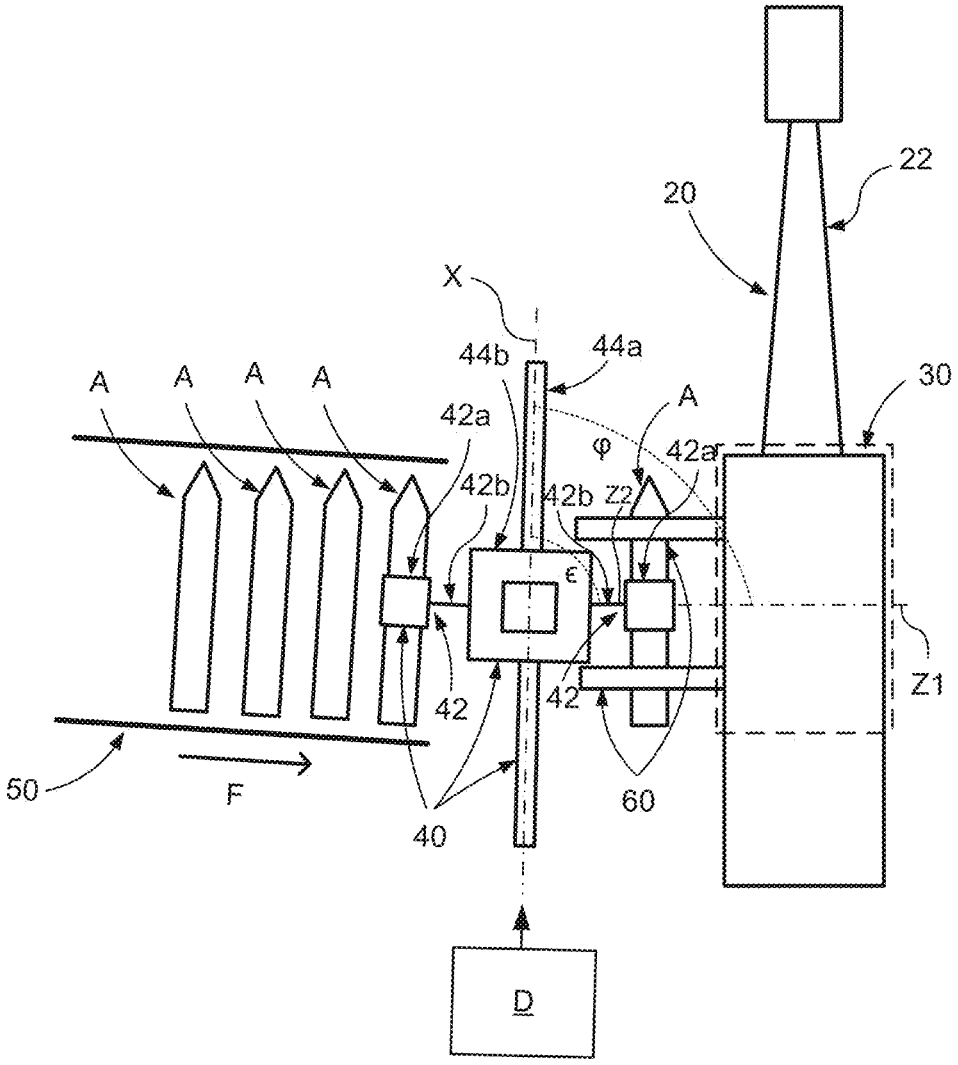

FIG. 11 schematically illustrates a plan view of a weapon 20, an ammunition channel 50 and an arrangement for feeding ammunition from said channel 50 to said weapon 20 according to an aspect of the present disclosure. Said feeding device 40 may be associated with a feeding device 40 according to FIG. 3-5.

FIG. 11 differs from e.g. FIG. 3 in that said feeding device 40 is arranged so that said feeding axis X has an angle $\varphi$ relative to said elevation axis Z1 which is non-orthogonal, here slightly smaller than a straight angle. Said axis Z2, about which said ammunition grip member 42 is rotatably arranged, has an angle $\epsilon$ relative to said feeding axis X essentially corresponding to said predetermined angle $\varphi$, i.e. an angle $\epsilon$ essentially corresponding to said angle $\varphi$. In e.g. FIG. 3, said angle $\varphi$ relative to said elevation axis Z1 is orthogonal, i.e. straight, and hence the axis Z2, about which said ammunition grip member 42 is rotatably arranged, has an angle $\epsilon$ relative to said feeding axis X which is also orthogonal, i.e. straight.

According to an aspect of the present disclosure, said weapon 20 is arranged to be elevated about said elevation axis Z1 within a range between a maximum elevation angle and minimum elevation angle, said elevation of said weapon 20 about said elevation axis Z1 forming an imaginary plane. Said feeding axis X having a predetermined angle $\varphi$ relative to said elevation axis Z1 which is non-orthogonal, here slightly smaller than a straight angle, as illustrated in FIG. 11, thus results in said feeding axis X having an angle relative to said imaginary plane corresponding to the elevation of said weapon 20 about said elevation axis X. When said feeding axis X is orthogonal relative to said elevation axis X, as illustrated in e.g. FIG. 3, the direction of extension of said feeding axis X is parallel to said imaginary plane corresponding to the elevation of said weapon 20 about said elevation axis X.

According to an aspect of the present disclosure, as illustrated in FIG. 11, said at least one ammunition grip member 42 is connected to said grip member support configuration 44 so that said at least one ammunition grip member 42 is rotatable about an axis Z2 with an angle $\epsilon$ relative to said feeding axis X which is non-orthogonal, here slightly smaller than a straight angle.

According to an aspect of the present disclosure, said at least one ammunition grip member 42 is configured to protrude from said grip member support configuration 44 in an axial direction corresponding to the axis Z2 with an angle $\epsilon$ relative to the radial direction relative to the extension of the feeding axis X. When there is more than one ammunition grip member 42, as in FIG. 10, each ammunition grip member 42 is configured to protrude with a corresponding angle $\epsilon$ relative to the radial direction, i.e. orthogonal direction from the feeding axis X.

According to an aspect of the present disclosure, when said grip member 42 is positioned in the ammunition release location, the direction of extension of said axis Z2 about which said grip member 42 is rotatably arranged is configured to essentially correspond to the direction of extension of said elevation axis Z1. According to an aspect of the present disclosure, when said grip member 42 is positioned in the ammunition release location, the direction of extension of said axis Z2 about which said grip member 42 is rotatably arranged is configured to be essentially aligned with the direction of extension of said elevation axis Z1.

The embodiment illustrated in FIG. 11 for a feeding arrangement similar to the feeding arrangement in e.g. FIG. 3, is also applicable for a feeding arrangement similar to the feeding arrangement in e.g. FIG. 6.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated.

The invention claimed is:

1. An arrangement for feeding ammunition to a weapon, the weapon being mounted to an elevation device arranged to allow elevation movement of the weapon about an elevation axis, the arrangement comprising:

an ammunition feeding device arranged between an ammunition channel, from which ammunition is guided, and said weapon, wherein:

the elevation movement of the weapon being a movement relative to said ammunition channel, said ammunition feeding device;

being arranged to feed ammunition from said ammunition channel to said weapon, being rotatably arranged about a feeding axis, having at least one ammunition grip member configured to rotate with said ammunition feeding device about said feeding axis between an ammunition collection location at said ammunition channel, in connection to which said at least one ammunition grip member is configured to collect ammunition from said ammunition channel, and an ammunition release location at said weapon, in connection to which said at least one ammunition grip member is configured to release collected ammunition so that collected ammunition is fed into the weapon, said at least one ammunition grip member is rotatably arranged about a second axis relative to said feeding axis and different from said feeding axis, said arrangement is configured such that said at least one ammunition grip member is configured to be rotatably adaptable based on an elevation of said weapon so as to facilitate feeding the ammunition to the weapon in connection to the ammunition release location independent of the elevation of said weapon.

2. The arrangement of claim 1, wherein said arrangement is configured such that said at least one ammunition grip member is configured to be rotatably adaptable based on an elevation angle of said weapon relative to a direction of extension of said feeding axis.

3. The arrangement of claim 1, wherein;

said ammunition feeding device is configured to be arranged so that said feeding axis has a predetermined angle relative to said elevation axis, and said at least one ammunition grip member is rotatably arranged about the second axis to have an angle relative to said feeding axis corresponding to said predetermined angle.

4. The arrangement of claim 3, wherein;

said at least one ammunition grip member is configured to be subjected to a rotational force based on an elevation angle of the elevation of said weapon relative to a direction of extension of said feeding axis so that said at least one ammunition grip member is rotated about said second axis from a neutral non-rotated position at said ammunition collection location to a rotated position corresponding to the elevation angle of the elevation of said weapon at said ammunition release location so that the ammunition to be released and fed into said weapon is positioned in accordance with the elevation of the weapon.

5. The arrangement of claim 3, wherein said ammunition feeding device is configured to be arranged so that said feeding axis is orthogonal relative to said elevation axis, wherein said second axis about which said at least one ammunition grip member is rotatably arranged is orthogonal relative to said feeding axis.

6. The arrangement of claim 3, wherein said at least one ammunition grip member is resiliently rotatably arranged about said second axis so that said at least one ammunition grip member is maintained in a neutral non-rotated position when not subjected to any rotational force and returns to said neutral non-rotated position when a rotational force to which said at least one ammunition grip member has been subjected is released.

7. The arrangement of claim 1, wherein:

said ammunition feeding device comprises a grip member support configuration configured to rotate about said feeding axis and configured to support said at least one ammunition grip member, and said at least one ammunition grip member is connected to and configured to protrude from said grip member support configuration so that said at least one ammunition grip member is rotatable about the second axis relative to said feeding axis.

8. The arrangement of claim 7, wherein said grip member support configuration comprises a rotation axle configured to provide said rotation of said ammunition feeding device about said feeding axis and a support member connected to said rotation axle and configured to support said at least one ammunition grip member.

9. The arrangement of claim 7, wherein said at least one ammunition grip member is resiliently connected to said grip member support configuration so that:

said at least one ammunition grip member is held in a neutral non-rotated position associated with said second axis when not subjected to any rotational force for rotation about said second axis, and said at least one ammunition grip member returns to said neutral non-rotated position when a rotational force having resulted in a rotation of said at least one ammunition grip member to a rotational position about said second axis is released.

10. The arrangement of claim 9, wherein said at least one ammunition grip member comprises a grip portion configured to collect and release ammunition, and a connection member configured to connect said grip portion to said grip member support configuration so as to allow rotation about said feeding axis and so as to facilitate said resilient connection of said at least one ammunition grip member to said grip member support configuration.

11. The arrangement of claim 7, wherein said ammunition feeding device comprises three ammunition grip members evenly distributed around said grip member support configuration.

12. The arrangement of claim 1, further comprising a grip member rotation arrangement configured to rotatably adapt said at least one ammunition grip member based on the elevation of said weapon.

13. The arrangement of claim 12, wherein said grip member rotation arrangement comprises a steering arm configuration fixedly attached to said weapon and/or elevation device arranged to face said ammunition feeding device so that said at least one ammunition grip member, when having collected an ammunition and rotating about said feeding axis towards said ammunition release location, is configured to be rotated by said steering arm configuration based on the elevation of said weapon.

14. The arrangement of claim 13, wherein said steering arm configuration comprises a set of arms arranged so that, when said at least one ammunition grip member has collected an ammunition and is rotating about said feeding axis towards said ammunition release location, collected ammunition is brought into contact with said set of arms so that said at least one ammunition grip member carrying said ammunition is rotated based on the elevation of said weapon.

15. The arrangement of claim 12, wherein said grip member rotation arrangement comprises an axle configuration configured such that, when said at least one ammunition grip member is rotating about said feeding axis towards said ammunition release location, an axial movement in an axial direction of the feeding axis is provided based on the elevation of said weapon, wherein said axial movement is transferred to a rotational movement of said at least one ammunition grip member so that said at least one ammunition grip member is rotated based on the elevation of said weapon.

16. The arrangement of claim 15, wherein:

said axle configuration comprises at least one bar member for said at least one ammunition grip member and a bar member contactor fixedly attached to or integrated with said weapon and/or elevation device, said at least one bar member having an axial extension parallel to the feeding axis and being configured to rotate with said ammunition feeding device about said feeding axis, when said at least one ammunition grip member is rotating about said feeding axis towards said ammunition release location, said at least one bar member is brought into contact with said bar member contactor providing a first force so that said at least one bar member is moved in the axial direction of the feeding axis based on the elevation of said weapon, and said at least one bar member is arranged in connection to said at least one ammunition grip member so that said axial movement is transferred to said rotational movement of said at least one ammunition grip member so that said at least one ammunition grip member is rotated based on the elevation of said weapon.

17. The arrangement of claim 16, wherein said at least one bar member has an end portion configured to be brought in contact with a curved surface portion of said bar member contactor so as to facilitate providing said first force so that said at least one bar member is moved in the axial direction of the feeding axis based on the elevation of said weapon.

18. The arrangement of claim 16, wherein;

said at least one bar member has a bar engagement portion, said at least one ammunition grip member has a rotation engagement portion, and said bar engagement portion of the at least one bar member is configured to be engaged with said rotation engagement portion of the at least one ammunition grip member such that when said at least one ammunition grip member is rotating about said feeding axis towards said ammunition release location so that said at least one bar member is moved in the axial direction of the feeding axis based on the elevation of said weapon, said axial movement is transferred to said rotational movement of said at least one ammunition grip member by engagement between said bar engagement portion and said rotation engagement portion.

19. The arrangement of claim 16, wherein:

said at least one bar member is resiliently arranged so that said at least one ammunition grip member is maintained in said neutral non-rotated position when the at least one bar member associated with the at least one ammunition grip member is not subjected to a second force and thus is not moved in the axial direction, and so that said at least one ammunition grip member is returned to said neutral non-rotated position when the second force to which said at least one bar member has been subjected, having moved said at least one bar member in the axial direction and transferred said second force to said at least one ammunition grip member so that said at least one ammunition grip member has been rotated to a rotated position is released.

20. The arrangement of claim 19, wherein said axle configuration comprises a spring member for said at least one bar member so as to provide said resilient arrangement of said at least one bar member.

21. The arrangement of claim 1, wherein said ammunition feeding device is arranged to be rotated about said feeding axis so that said at least one ammunition grip member is rotated about said feeding axis in a rotational plane corresponding to the extension of said elevation axis of said weapon.

22. The arrangement of claim 1, wherein said ammunition feeding device is arranged to be rotated about said feeding axis by a drive axle system based on a rate of fire of the weapon so that said at least one ammunition grip member feeds ammunition from said ammunition channel to said weapon by collecting and releasing ammunition in a repeated cycle.

23. The arrangement of claim 1, wherein said weapon is arranged to be elevated within a range between a maximum elevation angle and minimum elevation angle, the weapon having a neutral position there between, said neutral position corresponding to a horizontal extension of said weapon when the arrangement comprising the elevation device is arranged at horizontal ground.

24. A vehicle comprising the arrangement of claim 1 for feeding ammunition from the ammunition channel to the weapon of a weapon system mounted on the vehicle.

25. The vehicle of claim 24, wherein the vehicle is a tracked vehicle.

* * * * *